US012104387B2

(12) United States Patent
Drevet

(10) Patent No.: US 12,104,387 B2
(45) **Date of Patent: *Oct. 1, 2024**

(54) PANEL LOCKING SYSTEM AND PANELS THEREFOR

(71) Applicant: COLUMBIA INSURANCE COMPANY, Omaha, NE (US)

(72) Inventor: Anthony Drevet, Chattanooga, TN (US)

(73) Assignee: Columbia Insurance Company, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/330,826

(22) Filed: Jun. 7, 2023

(65) Prior Publication Data

US 2023/0313540 A1 Oct. 5, 2023

Related U.S. Application Data

(63) Continuation of application No. 17/489,166, filed on Sep. 29, 2021, now Pat. No. 11,708,698.

(Continued)

(51) Int. Cl.

| | |
|---|---|
| ***E04F 13/00*** | (2006.01) |
| ***E04F 13/08*** | (2006.01) |
| *E04F 13/14* | (2006.01) |

(52) U.S. Cl.

CPC ..... *E04F 13/0894* (2013.01); *E04F 13/142* (2013.01); *E04F 2201/0107* (2013.01);

(Continued)

(58) Field of Classification Search

CPC ..... E04F 15/02033; E04F 15/02038; E04F 15/107; E04F 15/102; E04F 13/0866; E04F 13/0894; E04F 15/105; E04F 2201/042; E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138; B32B 3/06; B32B 5/02; B32B 27/08; B32B 27/12; B32B 27/20; B32B 27/304;

(Continued)

(56) References Cited

U.S. PATENT DOCUMENTS

| | | | | |
|---|---|---|---|---|
| 8,375,672 | B2 * | 2/2013 | Hannig | E04F 15/02038 52/591.1 |
| 8,402,707 | B2 * | 3/2013 | Mitchell | E04F 13/18 52/287.1 |

(Continued)

*Primary Examiner* — Chi Q Nguyen
(74) *Attorney, Agent, or Firm* — Ballard Spahr LLP

(57) ABSTRACT

A panel can have a face surface having a length and a width. The panel can include a first tongue that extends along the length and a second tongue that extends along the width. The pane can further include first front and back legs that extend along the length of the panel and define a first groove therebetween and second front and back legs that extends along the width of the panel and define a second groove. At least one of the first tongue or the first back leg can a longitudinal dimension that is greater than the length of the face surface; or at least one of the second tongue or the second back leg can have a longitudinal dimension that is greater than the width of the face surface.

9 Claims, 18 Drawing Sheets

Related U.S. Application Data

(60) Provisional application No. 63/085,715, filed on Sep. 30, 2020.

(52) U.S. Cl.
CPC ... *E04F 2201/023* (2013.01); *E04F 2201/043* (2013.01); *E04F 2290/00* (2013.01)

(58) Field of Classification Search
CPC ..... B32B 2255/10; B32B 2307/412; B32B 2307/554; B32B 2307/558; B32B 2307/72; B32B 2419/00; B32B 2451/00; B32B 2471/00
See application file for complete search history.

(56) References Cited

U.S. PATENT DOCUMENTS 8,745,949 B1 * 6/2014 Pien ..... E04F 15/02038 52/510
8,875,464 B2 * 11/2014 Pervan ..... E04F 13/0894 52/581
11,505,949 B2 * 11/2022 Meersseman ..... E04F 15/02038
11,708,698 B2 * 7/2023 Drevet ..... E04F 13/0894 52/588.1
2003/0101674 A1 * 6/2003 Pervan ..... E04F 15/02033 52/592.1
2008/0010931 A1 * 1/2008 Pervan ..... E04F 15/02 52/403.1
2009/0193741 A1 * 8/2009 Cappelle ..... E04F 15/048 29/897.3
2010/0281810 A1 * 11/2010 Ruland ..... E04F 15/02 52/588.1
2012/0266555 A1 * 10/2012 Cappelle ..... E04F 15/02194 52/309.1
2013/0008118 A1 * 1/2013 Baert ..... B29C 63/044 156/60
2016/0193857 A1 * 7/2016 De Mondt ..... B41J 11/0015 52/311.1

* cited by examiner

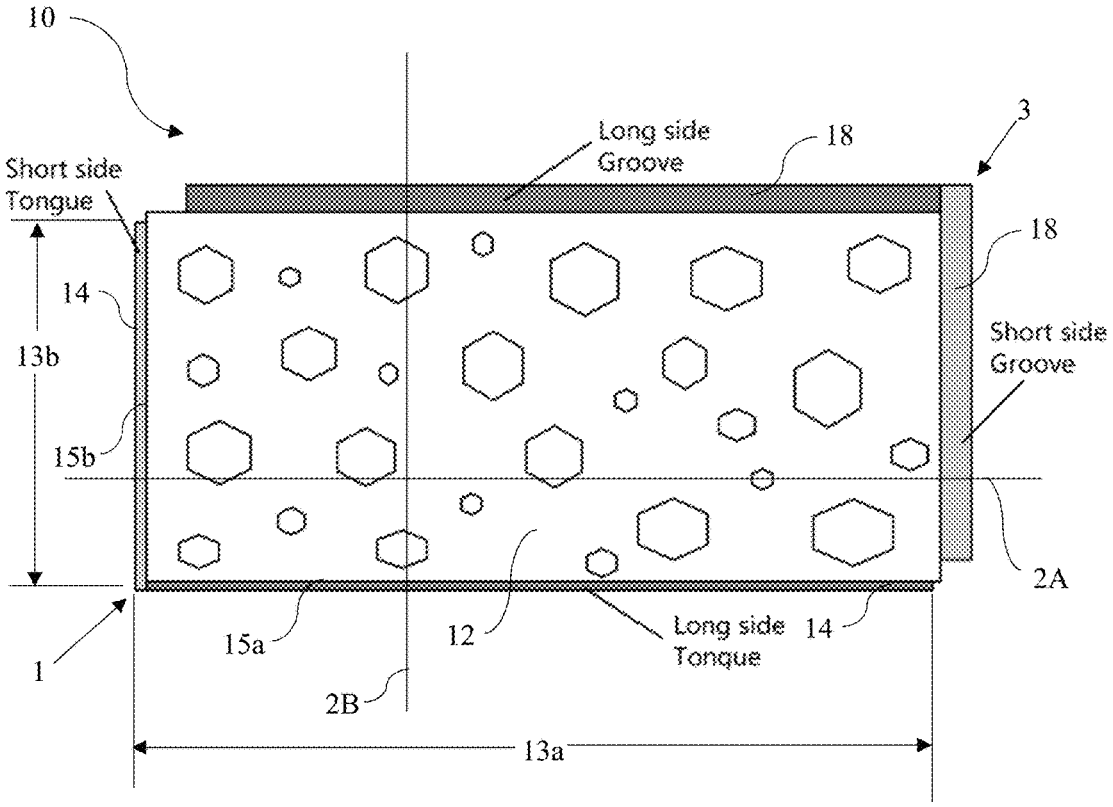
(Prior Art)
FIG. 1
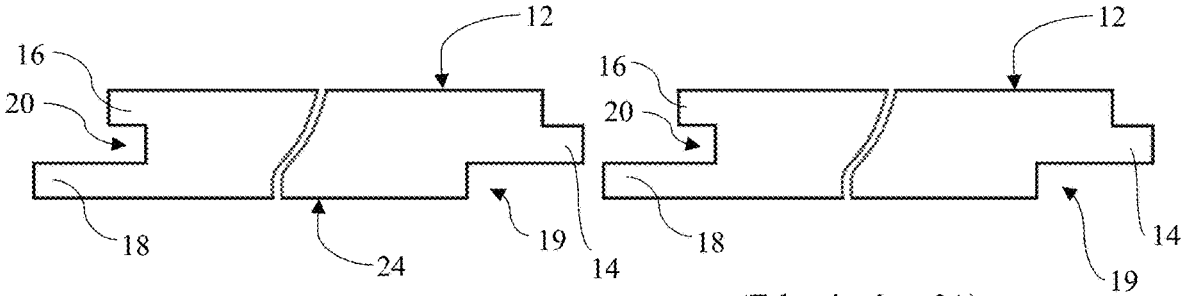
(Taken in plane 2B)
(Prior Art)
(Taken in plane 2A)
FIG. 2B
FIG. 2A

PANEL LOCKING SYSTEM AND PANELS THEREFOR

CROSS-REFERENCE TO RELATED APPLICATIONS

This application is a continuation of U.S. patent application Ser. No. 17/489,166, filed Sep. 29, 2021, now U.S. Pat. No. 11,708,698, which claims priority to and the benefit of the filing date of U.S. Provisional Patent Application No. 63/085,715, filed Sep. 30, 2020, the entirety of each of which is hereby incorporated by reference herein.

FIELD

This disclosure is directed to panel components having tongue and groove portions.

BACKGROUND

Ceramic tile constitute a majority of wall coverings used in residential showers. Ceramic tiles are durable and low-cost and therefore suitable for vertical installation in wet areas. However, one of the main disadvantages of ceramic tiles is the complex installation that requires a skilled installer. Poor installation can lead to cracking over time and/or leaks that can cause mold or structural damage to the residence.

Various products have been developed for wet surfaces such as vertical shower wall panels or coverings that do not require the need for professional installation and can be installed via the general population of do-it-yourself (DIY) individuals. For example, U.S. Pat. No. 6,397,547 to Martensson and U.S. Patent Publication No. 2020/0131783 to Liu et al. attempt to provide leak-free panels. However, these panels are subject to major water leaking concerns where corners of adjacent panels meet due to features that are consistent with conventional tongue and groove panels.

Referring to FIGS. 1 and 2, conventional panels 10 configured for tongue and groove interconnections have a face 12. Two adjacent sides that meet in a first corner have a respective tongue 14 extending therefrom. Front legs 16 and back legs 18 on the other two sides define a groove 20 therebetween that is configured to receive the tongue 14 of another panel 10. The tongues 14 conventionally have longitudinal dimensions 13*a*, 13*b* that are shorter than or equal to the longitudinal dimensions of the respective side 15*a*, 15*b* of the face 12 along which it extends. In this way, the tongue 14 does not interfere with the tongue 14 of an adjacent, interlocking panel. Likewise, and for the same reason, the front legs 16 and back legs 18 that define the groove 20 conventionally have longitudinal dimensions that are shorter than or equal to the longitudinal dimension of the respective side of the face 12 along which they extend. The longitudinal dimensions 13*a*, 13*b* of the tongues 14 being shorter than or equal to the longitudinal dimensions of the respective side 15*a*, 15*b* of the face 12 is also a byproduct of manufacturing. Because the grooves and the tongues are at the same position relative to the thickness of the panel, a milling tool that cuts each groove also forms an adjacent end of a respective tongue.

Referring also to FIGS. 3-5, if the corners and sides of two to four adjacent panels are not perfectly adjoined, water can pass through the gap 21 between the faces 12 of the adjacent panels. Although perfect installation (without gaps 21) may be possible in a lab setting or with few panels, such a perfect installation is not practical for large installations. Factors such as installer skill and care can allow for deviation from perfect installation, and an uneven or rough subsurface (e.g., sheetrock) can make perfect installation impracticable or impossible. That is, existing solutions rely on installer care and do not allow for tolerances of slightly uneven or rough subsurfaces. Referring also to FIG. 6, conventionally, tongues have respective widths (in the respective lateral dimensions extending from the respective sides 15*a*,15*b*) that are shorter than the depths of their respective grooves in order to allow for imperfect tolerances in milling or forming these dimensions (as well as allowing for expansion without buckling or bowing of the panels). These unequal tongue width and groove depth dimensions can define conduits 22*a* that can communicate water that leaks behind the faces of panels, and the water can then leak behind the panel, on a back side 24 of the panel opposite the face 12, ultimately leading to water damage. Similarly, the panel 10 can define a recess behind each tongue 14 that is configured to receive the back leg 18 of an adjacent panel 10. The recess 19 can have a depth that is greater than the width of the back leg (in its respective transverse dimension) to thereby provide a clearance allowing for imperfect tolerances in milling. These unequal dimensions can likewise define conduits 22*b* that similarly communicate water therethrough so that the water can ultimately flow behind the panels. Because the unequal dimensions of the tongue width and groove depth as well as back leg width and recess depth are typically needed for the reasons stated, the conduits 22*a* and conduits 22*b* typically cannot be avoided.

Accordingly, referring also to the example scenario shown in FIGS. 5A and 5B, initial water breach can occur at an intersection of a first T-joint between an upper panel (see FIG. 4A) and two adjacent panels 10*a*, 10*b* therebelow. Water can travel past the faces 12 of the panels through non-abutting edges 23 (circled) of the face 12. Once behind the faces 12, water can travel through a first path (1) shown as the conduit 22*a* between the tongue and the groove and/or a second path (2) shown as the conduit 22*b* between the back leg 18 and the recess 19. When the water reaches a second T-joint between the two adjacent panels 10*a*, 10*b* and a lower panel 10*c*, the water can leak down the back side 24 (FIGS. 2A and 2B) of the lower panel 10*c* along a third path (3).

For these reasons, conventional tongue and groove panels are not suitable for surfaces that are exposed to moisture such as shower wall panels.

To avoid leaking at the corners, some shower wall panels are provided with dimensions of 2 feet by 8 feet or 4 feet by 8 feet so that the panels span the entire height of the shower wall and do not form unions that allow water therethrough. However, these panels do not provide the visually attractive tile format that many individuals prefer.

Silicone sealants can be used to seal edges of conventional panel systems. However, for various reasons, silicone is not always desirable to use or to rely on as the primary element for inhibiting water breach.

Accordingly, it is desirable to have a system of panels with interlocking tongue and groove connections that inhibit water from permeating through the system.

BRIEF DESCRIPTION OF THE DRAWINGS

FIG. 1 is a front view of a conventional tongue and groove panel.

FIG. 2A shows a first cross sectional view of the conventional tongue and groove panel of FIG. 1 in a plane 2A, viewing from the top side of the page. FIG. 2B shows a second cross sectional view of the conventional tongue and groove panel of FIG. 1 in a plane 2B, viewing from the left side of the page.

Figure 3:
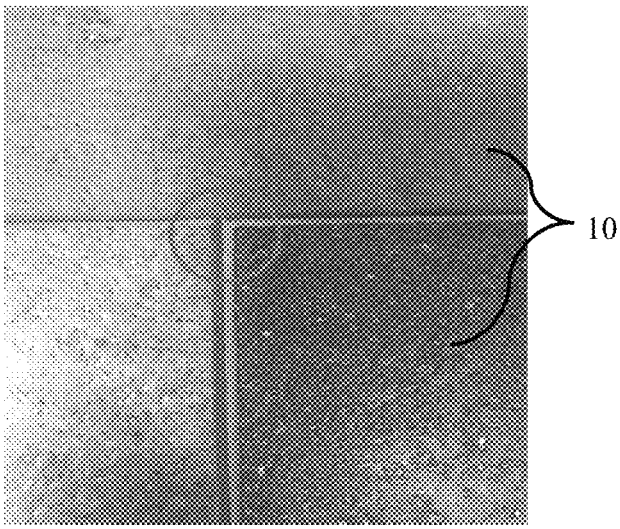
(Prior Art) FIG. 3
FIG. 3 is a front view of a surface covering of conventional tongue and groove panels with the tongue and groove panels mated without gaps therebetween.
Figure 4A:
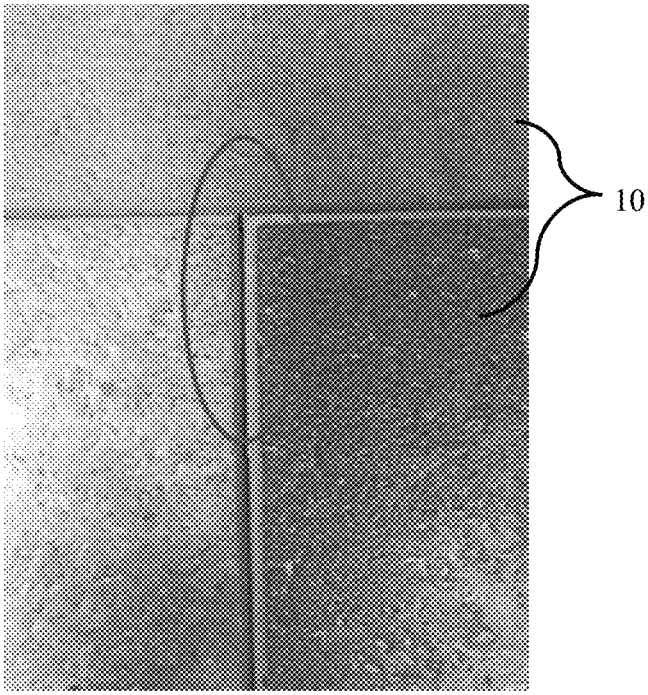
(Prior Art) FIG. 4A
FIG. 4A is a front view of a surface covering of conventional tongue and groove panels with a space between face portions of two adjacent tongue and groove panels.
Figure 4B:
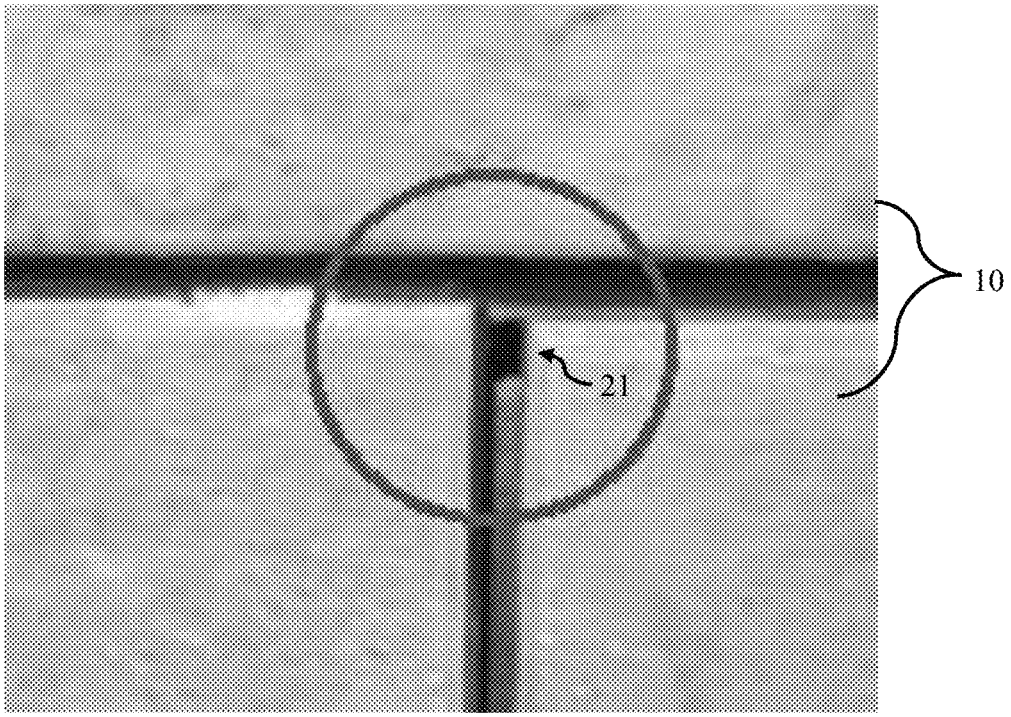
(Prior Art) FIG. 4B
FIG. 4B is a close up partial front view of the view in FIG. 4A, showing gaps that can lead to water permeating the surface covering by traveling behind the face portions of the tongue and grove panels.
Figure 5A:
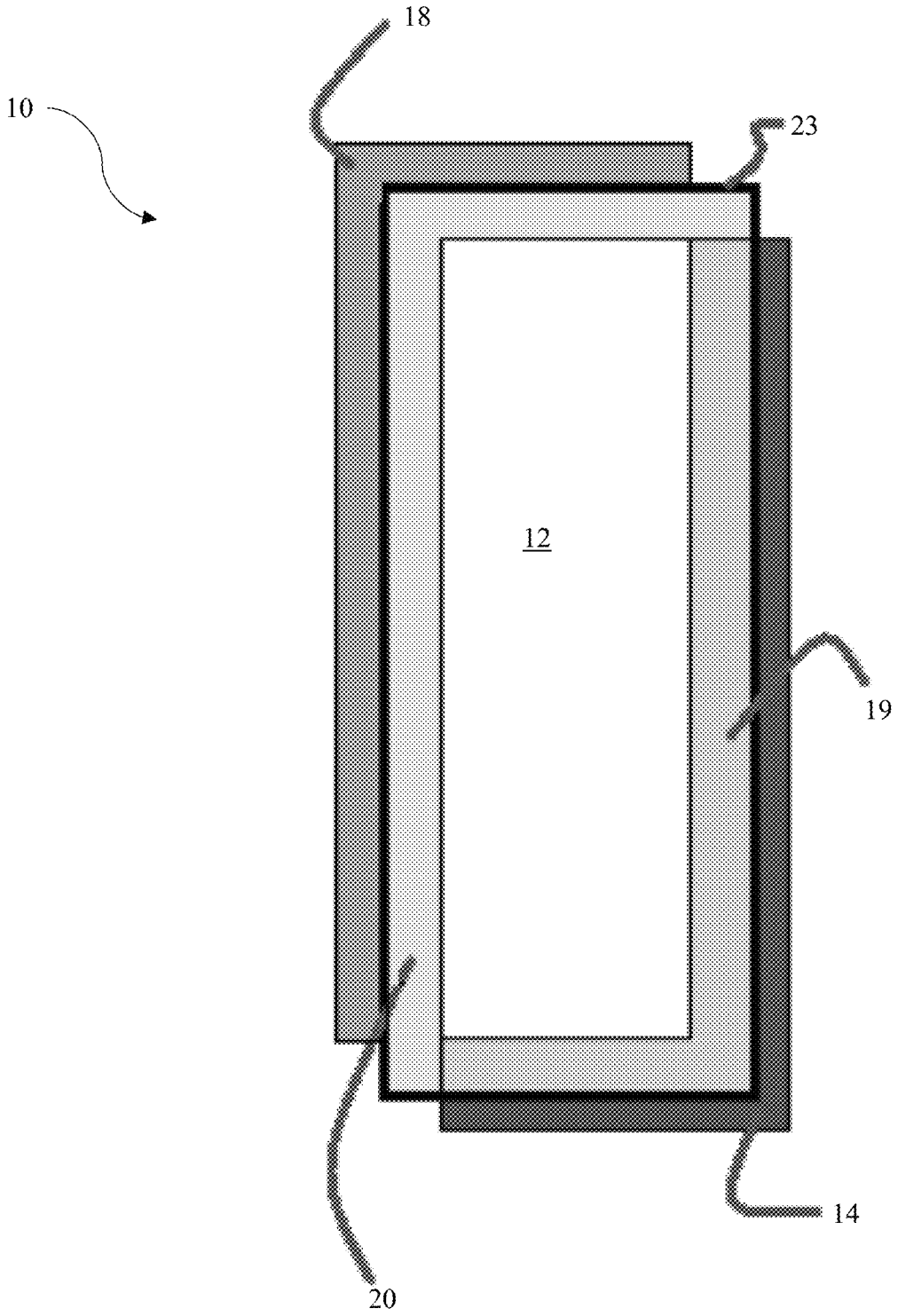
(Prior Art) FIG. 5A
FIG. 5A is a front view of a conventional tongue and groove panel.
Figure 5B:
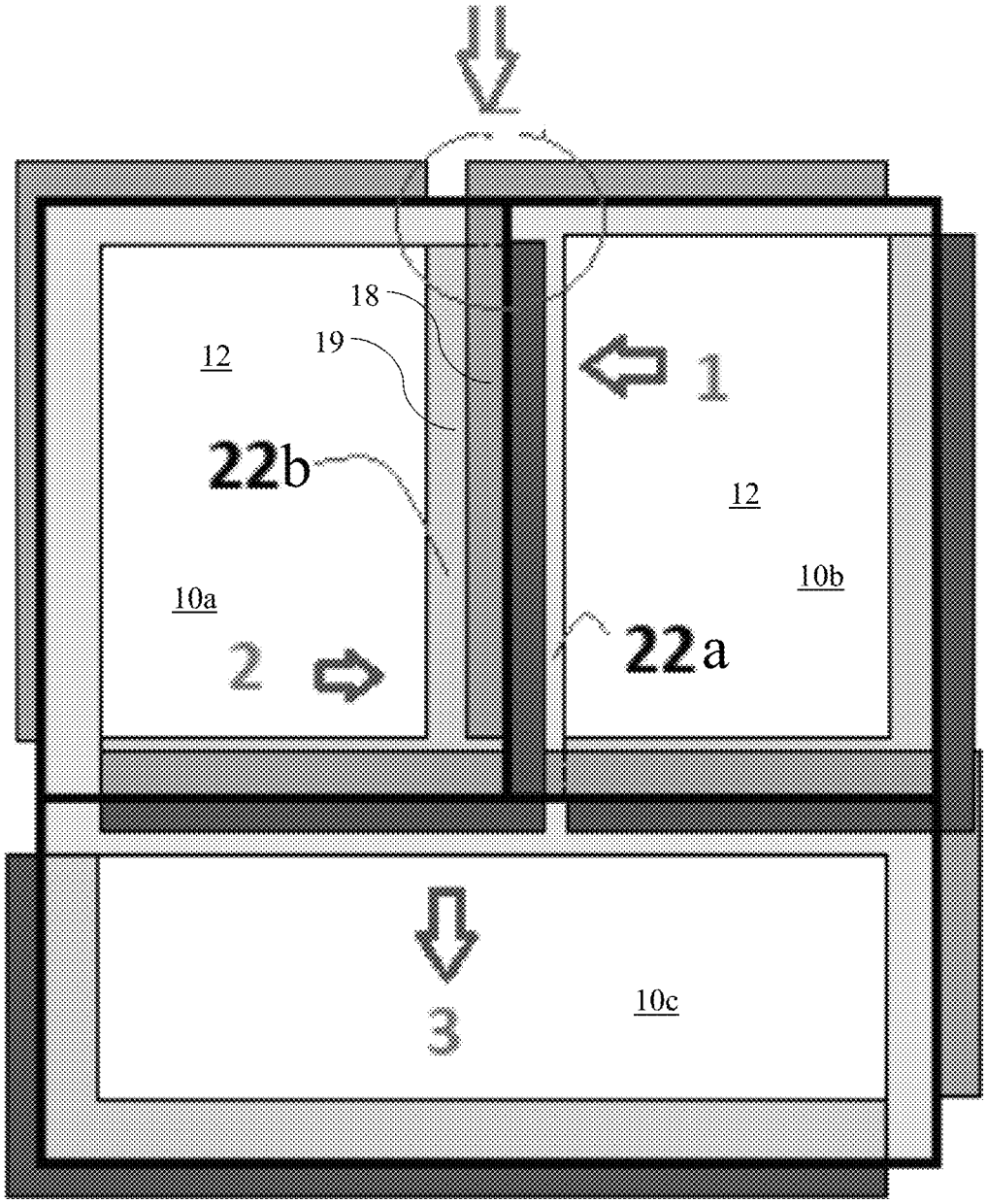
(Prior Art) FIG. 5B
FIG. 5B shows an arrangement of a plurality of the conventional tongue and groove panels of FIG. 5A.
Figure 6:
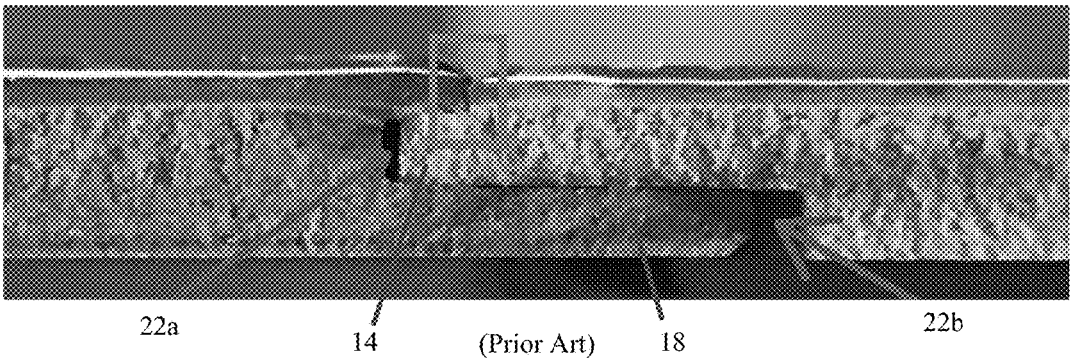
FIG. 6 is a cross sectional view of a surface covering comprising conventional tongue and groove panels having gaps between a tongue and a groove.

The drawings illustrate only example embodiments and are therefore not to be considered limiting of the scope of the disclosure, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present disclosure which will be limited only by the appended claims.

It must be noted that as used herein and in the appended claims, the singular forms "a," "an," and "the" include plural references unless the context clearly dictates otherwise. Thus, for example, reference to "a tongue" includes one or more of such tongues, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification. Thus, words denoting order, such as "first" or "next," should be interpreted as optional aspects unless plain meaning or logic dictates otherwise.

In conventional panels 10, the first and second tongues join or intersect at one end thereof as shown in corner 1 of FIG. 1. Further, the first and second back legs of the conventional panel 10 join or intersect at one end thereof as shown in corner 3 of FIG. 1. Furthermore, in conventional panels 10, the opposite ends (ends that are not joined at corner 1 or corner 3) of the first and second tongues and the first and second back legs are not connected, and the length (longitudinal dimension or long dimension) of the first tongue, second tongue, the first back leg, and the second back leg are shorter than the length of the respective edges of the face portion from which they protrude outward. For example, the length of the first tongue 14 of conventional panel 10 is less than the length of the first edge 15*a* of the face portion of the conventional panel 10, the length of the second back leg (right side back leg in FIG. 1) of the conventional panel 10 is less than the length of the fourth edge (right edge of face 12 in FIG. 1) of the face portion, etc.

In the panel 100 of the present disclosure, similar to the conventional panels 10, the first and second tongues can join at one end thereof, and the first and second back legs can join at one end thereof. However, in the panel 100 of the present disclosure, the longitudinal dimension (or length) of one or more of the first tongue, the second tongue, the first back leg, or the second back leg can be extended such that they can form an overlap with the tongues and/or back legs of another adjacent panel substantially near the corners thereof when the panels are coupled or interlocked. The overlap can create a water-tight seal or minimizes penetration/leak of water therethrough at the corners even when the interlocked panels are not perfectly aligned (e.g., with respective face portions abutting). In particular, the opposite ends of one or more of the first tongue, second tongue, the first back leg, and the second back leg can extend towards the fourth edge, second edge, third edge, and first edge respectively (will be described below in greater detail in association with FIGS. 7-9B, 10B-22, and 24-25). In the panel 100 of the present disclosure, the opposite ends of at least one of the first tongue, second tongue, the first back leg, and the second back leg can be extended along the longitudinal dimension such that the longitudinal dimension of the first tongue, second tongue, the first back leg, and the second back leg are greater than the length of the respective edges of the face panel from which they protrude. For example, the length of the first tongue of panel 100 is greater than the length of the first edge of the face portion of the panel 100, or the length of the second back leg is greater than the length of the fourth edge of the face portion of the panel 100. Said extension of the longitudinal dimensions of the tongues and back legs can be realized by adjusting a thickness or height of one or more of the tongues, grooves, and/or the front and back legs of the panel 100 that define the groove.

Disclosed herein, with reference to FIGS. 7-9A is a first embodiment of a panel 100 comprising a face surface 102 having a first edge 104 and a second edge 106 that extend along a first axis 90 and are spaced by a width 107 along a second axis 92 that is perpendicular to the first axis 90. The face surface 102 can have a third edge 108 and a fourth edge 110 that extend along the second axis 92 and are spaced by a length 105 along the first axis 90. Although illustrated as being generally rectangular, it is contemplated that the face surface 102 of the panel 100 can be square, having an equal length and width. The panel can have a back surface 112 that is spaced from the face surface along a third axis 94 that is perpendicular to the first and second axes 90, 92. The back surface 112 can have respective first, second, third, and fourth edges (not shown in figures) that correspond to the first, second, third, and fourth sides of the face surface 102.

A first side 114 can extend between the first edge 104 of face surface 102 and the back surface 112. The first side 114 can comprise at least one projection (e.g., a first tongue 116).

A second side 118 can extend between the second edge 106 of the face surface 102 and the back surface 112. The second side 118 can comprise at least one projection (e.g., a first front leg 120 and a first back leg 122 that cooperate to define a first groove 124 therebetween).

A third side 126 can extend between the third edge 108 of the face surface 102 and the back surface 112. The third side 126 can comprise at least one projection (e.g., a second tongue 128).

A fourth side 130 can extend between the fourth edge 110 of the face surface 102 and the back surface 112. The fourth side 130 can comprise at least one projection (e.g., a second front leg 132 and a second back leg 134 that cooperate to define a second groove 136 therebetween).

In some aspects, a body 101 of the panel 100 can define the face surface 102, the back surface 112, the first side 114, the second side 118, the third side 126, and the fourth side 130.

Figure 7:
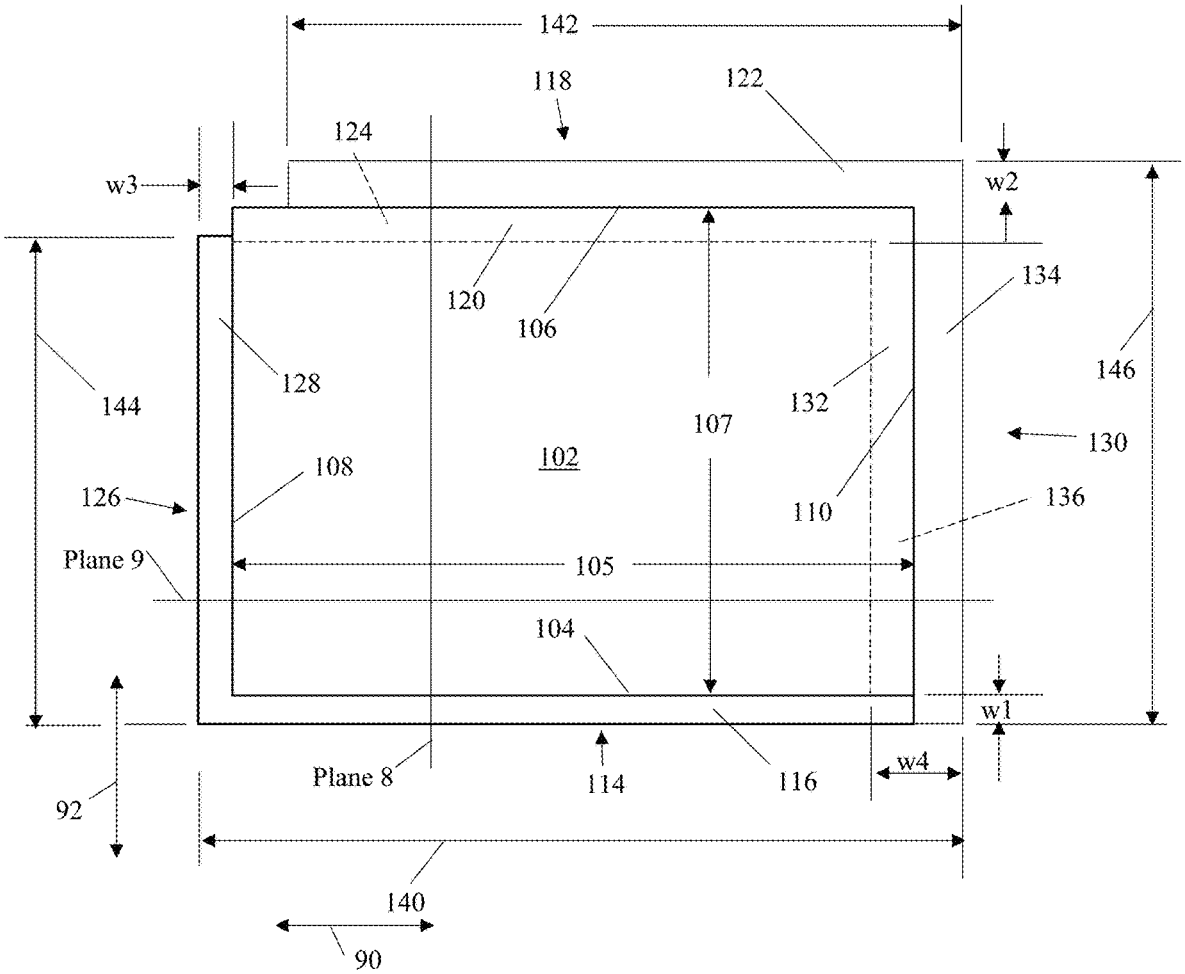
FIG. 7 is a front view of an exemplary panel in accordance with embodiments disclosed herein.

In the example embodiment illustrated in FIG. 7, the first tongue 116 can have a longitudinal dimension 140 (i.e., a first tongue length) and a first tongue width w1. The first back leg 122 can have a longitudinal dimension 142 (i.e., a first back leg length) and a first back leg width w2. The second tongue 128 can have a longitudinal dimension 144 (i.e., a second tongue length) and a second tongue width w3. The second back leg 134 can have a longitudinal dimension 146 (i.e., a second back leg length) and a second back leg width w4.

As defined herein, the first tongue 116 can be defined as any portion of the panel 100 that extends beyond a first plane 96 (shown in FIG. 8) that is perpendicular to the second axis 92 and intersects the first edge 104 of the face surface 102. Likewise, the second tongue 128 can be defined as any portion of the panel 100 that extends beyond a second plane 98 that is perpendicular to the first axis 90 and intersects the third edge 108 of the face surface 102. Alternatively, as illustrated in the example embodiments of FIGS. 8 and 9A, the first tongue 116 may be defined as a portion of the panel 100 that extends past or beyond the first edge 104 of the face surface 102 and along the second axis 92 in a direction away from the second edge 106 of the face surface 102. Similarly, the second tongue 128 may be defined as a portion of the panel 100 that extends beyond the third edge 108 of the face surface 102 along the first axis 90 in a direction opposite to the fourth edge 110. As defined herein, the first back leg 122 can be defined as a portion of the panel 100 that extends from an inner surface 125 of the first groove 124 relative to the second axis 92 and is disposed below a plane 127 that bisects the first groove 124 relative to the third axis 94. Likewise, the second back leg 134 can be defined as a portion of the panel that extends outwardly from an inner surface 137 of the second groove 136 relative to the first axis 90 and is disposed below a plane 139 that bisects the second groove 136 relative to the third axis 94. As illustrated in the example embodiments of FIGS. 7-9A, the first and second back legs (122, 134) can extend beyond the first and second front legs (120, 132) and the second and fourth edges (106, 110) of the face surface 102. Further, the first and second back legs (122, 134) can be disposed adjacent to the back surface 112 of the panel 100, and the first and second tongues (116, 128) can be disposed between the face surface 102 and the back surface 112.

Figure 10A:
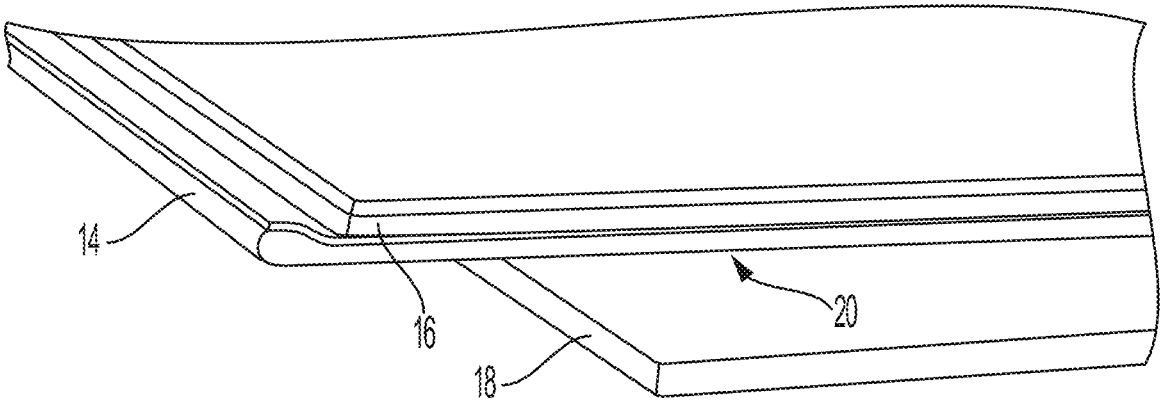
FIG. 10A is a perspective view of a corner of the conventional tongue and groove panel of FIG. 1.
Figure 10B:
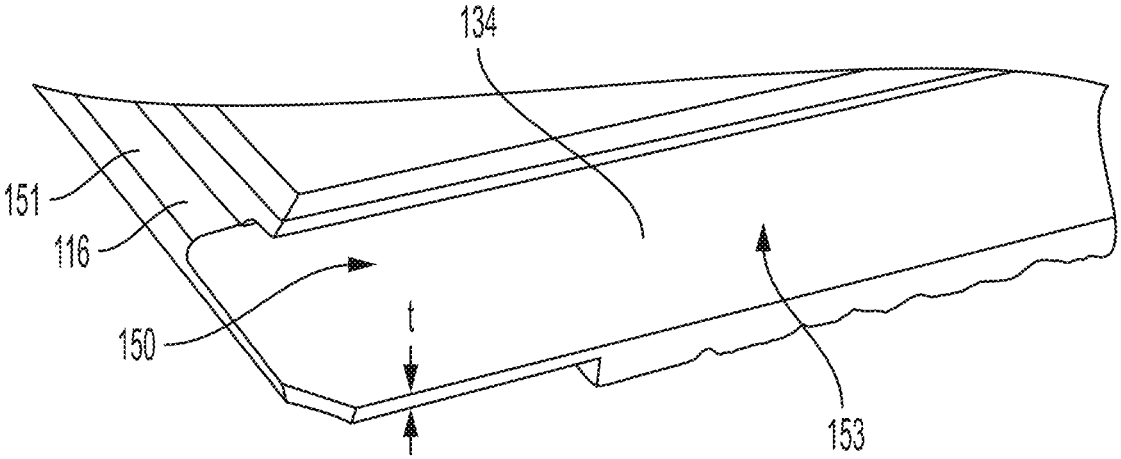
FIG. 10B is a perspective view of a corner of a panel with a tongue and groove as in FIG. 7.

It is contemplated that in some example embodiments a portion of the panel can define portions of both the first tongue 116 and the second tongue 128 (at their intersection). Likewise, it is contemplated that a portion of the panel can define portions of both the first back leg 122 and the second back leg 134. Further, in some optional aspects, as illustrated in FIG. 7 and FIG. 10B, at least a portion of the first tongue 116 and the second back leg 134 can intersect at a first tab 150) that defines both a portion of the first tongue 116 and a portion of the second back leg 134. In still further optional aspects, at least a portion of the second tongue 128 and the first back leg 122 can intersect at a second tab 152 (FIG. 17) that defines both a portion of the second tongue 128 and a portion of the first back leg 122.

Thus, in certain aspects, the first and second tongues 116, 128 and first and second back legs 122, 134 need not have a consistent thickness along their respective longitudinal dimensions. Rather, the first tab 150 (at an intersection between the first tongue 116 and the second back leg 134) can have a first tab thickness. Similarly, the second tab (at the intersection between the second tongue 128 and the first back leg 122) can have a second tab thickness. The first tab thickness and the second tab thickness can optionally be between 0.1 mm and 5 mm (e.g., between 0.2 mm and 5 mm, or between 0.2 mm and 1 mm, or between 0.2 mm and 0.5 mm). In various aspects, for embodiments having first and second tabs 150, 152, the respective tab thicknesses of the first and second tabs can be the same or different. It is contemplated that, for many materials, a small thickness can lead to breaking. Thus, a thickness of much lower than 0.1 mm or 0.2 mm be too breakable for certain material. However, in further optional aspects, for certain materials that are resistant to breaking, the thickness can be less than 0.1 mm. It is further contemplated that the tab must be receivable into a groove of an adjacent panel. As will be apparent, the first and second tabs can be the thinnest portion of the respective tongue. Therefore, the thickness of the groove can be limited by the maximum thickness of the tongue. Moreover, because of the overlap of the respective tongues and back legs of adjacent tiles at the tab(s) (e.g., the first tab 150 and the second tab 152), a large tab thickness can force misalignment between adjacent panels relative to the third axis 94. Accordingly, a minimum thickness that is sufficient to resist breaking can be desirable.

Thus, referring to FIG. 10B, in some aspects, the first tongue 116 can comprise the first tab 150 and a main body portion 151 (optionally, having uniform cross sections in planes perpendicular to the first axis 90). Likewise, the second back leg 134 can comprise the first tab 150 and a main body portion 153 (optionally, having uniform cross sections in planes perpendicular to the first axis 90). A first continuous surface can extend across a rear surface of the main body portion 151 of the first tongue 116 and a rear surface of the first tab 150, and a second continuous surface can extend across an forward surface of the main body portion 153 of the second back leg 134 and the forward surface of the first tab 150.

Figure 17:
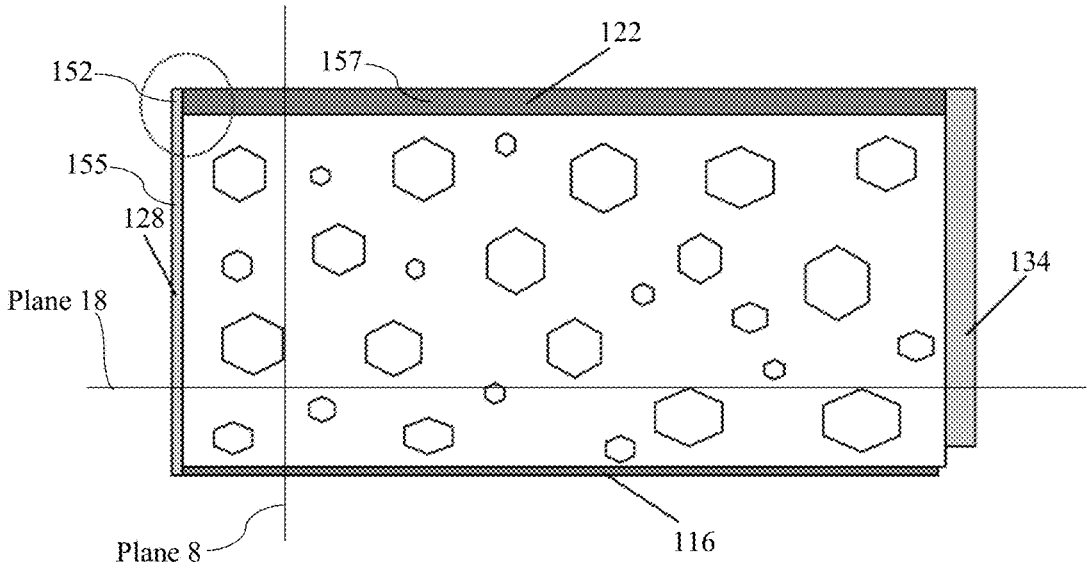
FIG. 17 is a front view of another exemplary panel in accordance with embodiments disclosed herein.

Similarly, in further aspects and with reference to FIG. 17, the second tongue 128 can comprise the second tab 152 and a main body portion 155 having consistent cross sections in planes perpendicular to the second axis 92. The first back leg 122 can comprise the second tab 152 and a main body portion 157 having consistent cross sections in planes perpendicular to the second axis 92. A first continuous surface can extend across a rear surface of the main body portion 155 of the second tongue 128 and a rear surface of the second tab 152, and a second continuous surface can extend across a forward surface of the main body portion 157 of the first back leg 122 and a forward surface of the second tab 152.

It is contemplated that the main body portions 151,155 of the first and second tongues 116,128 can have the same respective lengths as tongues of conventional tongue and groove panels. Likewise, the main body portions 157,153 of the first and second back legs 122,134 can have the same respective dimensions as back legs of conventional tongue and groove panels.

Referring to FIG. 7, in various aspects, at least one of the first tongue 116 or the first back leg 122 has a longitudinal dimension along the first axis 90 that is greater than the length 105 of the face surface, or at least one of the second tongue 128 or the second back leg 134 has a longitudinal dimension along the second axis that is greater than the width 107 of the face surface. In this way, at least one of the first or second tabs 150,152 as described above can overlap with a portion of an adjacent panel so that small misalignment between the panels (e.g., non-abutting face surfaces 102 of adjacent panels 100) does not expose any gaps for providing fluid communication. According to some aspects, the first tongue 116 and/or the first back leg 122 can be greater than the length of the face surface by at least 0.2 mm, at least 0.5 mm, at least 1 mm, at least 3 mm, or at least 1 cm. Similarly, the second tongue 128 and/or the second back leg 134 can be greater than the width of the face surface by at least 0.2 mm, at least 0.5 mm, at least 1 mm, at least 3 mm, or at least 1 cm.

In various aspects, at least one of the first tongue 116 or the first back leg 122 has a longitudinal dimension along the first axis 90 that is greater than the length of the face surface, and at least one of the second tongue 128 or the second back leg 134 has a longitudinal dimension along the second axis 92 that is greater than the width of the face surface.

Figure 8:
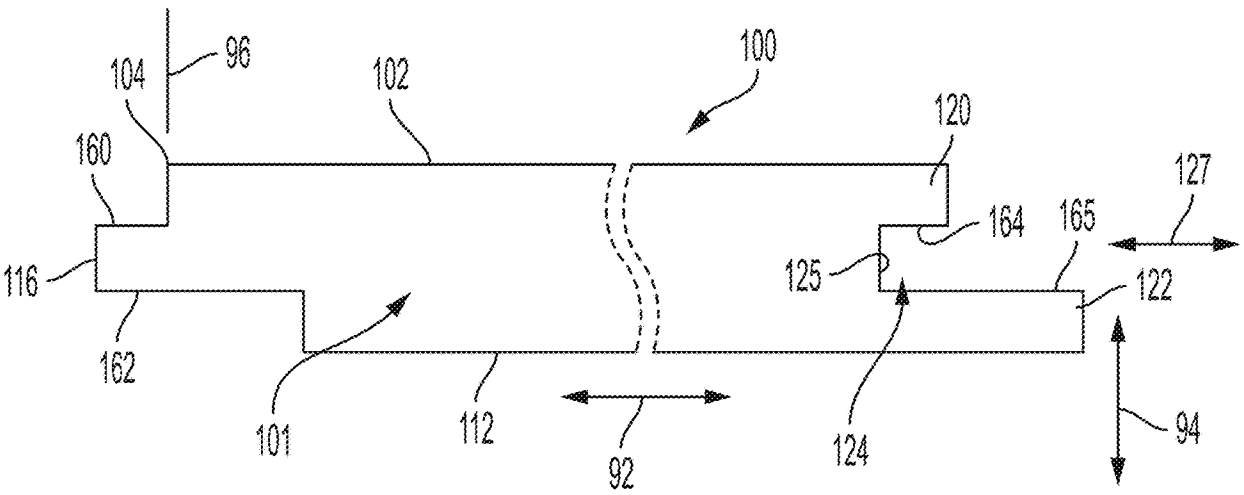
FIG. 8 is a cross sectional view of the panel of FIG. 7 taken in a plane 8, viewing from the right side of the plane 8.

Referring to FIGS. 7-9, according to a first embodiment of the panel 100, the first tongue 116 can extend away from the first edge 104 of the face surface 102 by the first tongue width w1 along the second axis 92. The second back leg 134 (longitudinal dimension thereof) can extend beyond the first edge 104 of the face surface 102 in a direction away from the second edge 106 of the face surface 102 by the first tongue width w1. That is, the second back leg 134 can extend beyond the first edge 104 of the face surface 102 by the same distance that the first tongue extends from the first edge 104.

FIG. 8 shows a cross sectional view of the panel of FIG. 7 taken in a plane 8. This cross section is representative of cross sections of other exemplary panels taken in plane 8 throughout this disclosure. As shown in FIG. 8, the first tongue 116 can have a forward surface 160 and a rear surface 162. The first front leg 120 can have a rear surface 164, and the first back leg 122 can have a forward surface 165. The second tongue 128 can have a forward surface 166 and a rear surface 168, the second front leg 132 can have a rear surface 170, and the second back leg can have a forward surface 172.

Conventionally, the forward and rear surfaces 166, 168 of the second tongue 128 and respective forward and rear surfaces 160,162 of the first tongue 116 are equally spaced from the face surface 102 relative to the third axis 94 (e.g., coplanar with each other) (e.g., in conventional panel 10). Likewise, conventionally, the rear surface 164 of the first front leg 120 and the rear surface 170 of the second front leg 132 are equally spaced from the face surface 102 relative to the third axis 94; and the forward surface 165 of the first back leg 122 and forward surface 172 of the second back leg 134 are conventionally equally spaced from the face surface 102 relative to the third axis 94. In order to provide the tab(s) (e.g., tabs 150, 152, etc.) that partially defines the tongue(s) and/or back leg(s) that are longer than their respective edges of the face surface 102 along which they extend, at least one of the forward or rear surfaces of the first tongue 116 can be offset from at least one of the forward or rear surfaces of the second tongue 128 relative to the third axis 94. In further optional aspects, the forward surface of the first back leg 122 can be offset from the forward surface of the second back leg 134 relative to the third axis 94. In still further aspects, the rear surface of the first front leg 120 can be offset from the rear surface of the second front leg 132 relative to the third axis 94.

Figure 9A:
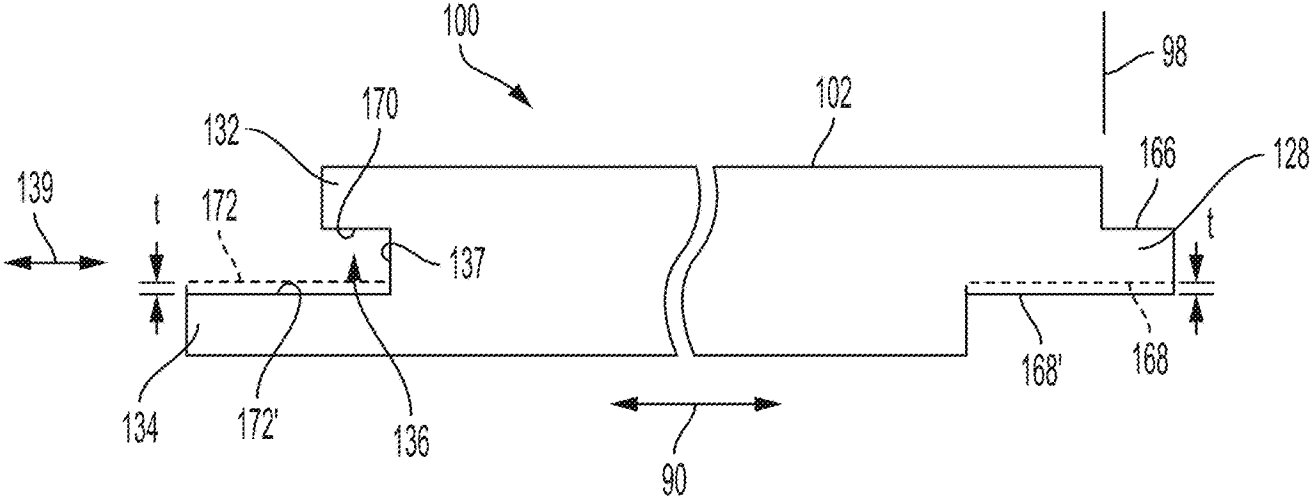
FIG. 9A is a cross sectional view of the panel of FIG. 7 taken in a plane 9, viewing downwardly along the page from above the plane 9.

For example, FIG. 9A, showing a cross section taken in plane 9 of FIG. 7, illustrates a position of the forward surface 172 of the second back leg 134 relative to its conventional position 172' on a conventional panel. As can be understood, the conventional position 172' of the second back leg 134 also corresponds to the spacing between the face surface 102 and the forward surface 165 of first back leg 122 relative to the third axis 94, as shown in FIG. 8. The position of the rear surface 168 of the second tongue 128 is shown relative to its conventional position 168' on a conventional panel (corresponding to the position of the rear surface 162 of the first tongue 116 as shown in FIG. 8). As can be seen, the first embodiment of the panel 100 (embodiment in FIG. 7) can be formed by spacing the rear surface 168 of the second tongue 128 from the rear surface 162 of the first tongue 116 (shown as the spacing between the rear surface 168 of the second tongue 128 and the conventional position 168' of the rear surface) along the third axis 94 by a tab thickness t, and the forward surface 172 of the second back leg 134 can be spaced from the forward surface 165 of the first back leg 122 along the third axis 94 by the tab thickness tin a direction toward the face surface 102. Accordingly, the first back leg 122 can have a thickness (relative to the third axis 94) that is less than the thickness of the second back leg 134, and the first tongue 116 can have a thickness that is greater than the thickness of the second tongue 128 by the tab thickness t.

Figure 9B:
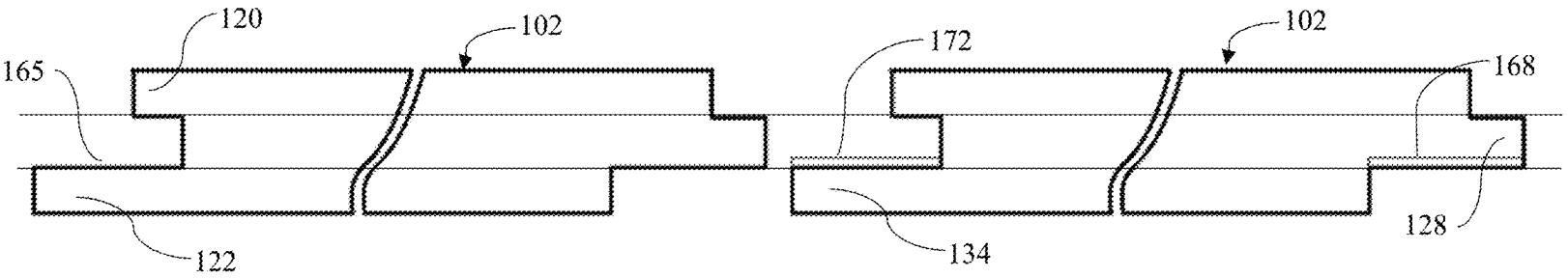
FIG. 9B is a comparison of the cross sections of FIGS. 8 and 9A with reference lines to show spacing of various surfaces.

FIG. 9B illustrates a comparison of the cross section taken in plane 8 (FIG. 8) and the cross section taken in plane 9 (FIG. 9A) with reference planes at various distances from the face surface 102 relative to the third axis 94. As can be seen, the forward surface 172 of the second back leg 134 is spaced closer to the face surface 102 than the forward surface 165 of the first back leg 122, and the rear surface 168 of the second tongue 128 is spaced closer to the face surface 102 than the rear surface of the first tongue 116.

Referring to FIG. 10B, in offsetting the surfaces of the tongues and front legs as described, the first tab 150 can be formed having the tab thickness t. The first tab 150 can define both the second leg and the first tongue. This can contrast to the image of FIG. 10A, showing a conventional panel in which the tongue and groove do not meet.

In various aspects, the sides of the panel 100 can be formed via milling. Accordingly, dimensions of the milling tools (relative to the third axis 94) and the respective positions of the milling tools relative to the third axis 94 as they move along the respective edges can determine the positions of the forward surfaces (e.g., upper surfaces for a flooring application) and rear surfaces (e.g., lower surfaces for a flooring application) of the tongues, front legs, and back legs, as further described herein. As can be understood, the respective forward and rear surfaces of each tongue and corresponding groove on opposing sides of the panel can have similar positions relative to the third axis 94 to enable mating of adjacent panels.

Figure 12B:
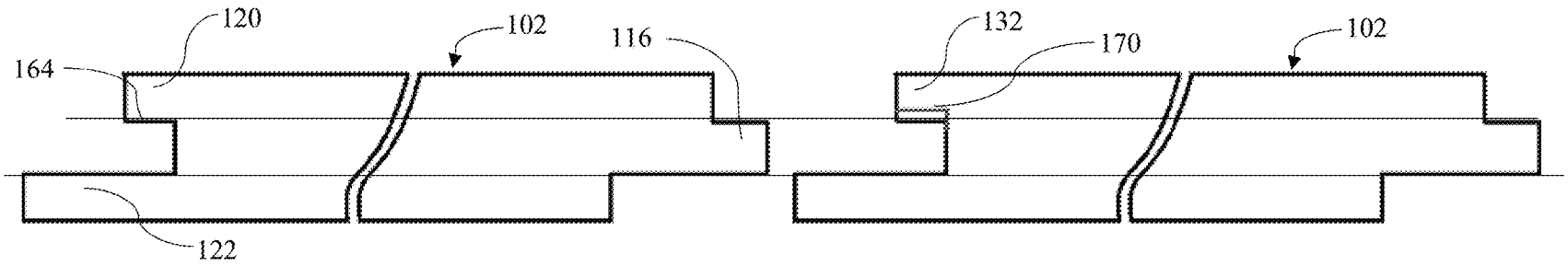
FIG. 12B is a comparison of the cross sections of FIGS. 8 and 12A with reference lines to show spacing of various surfaces.
Figure 11:
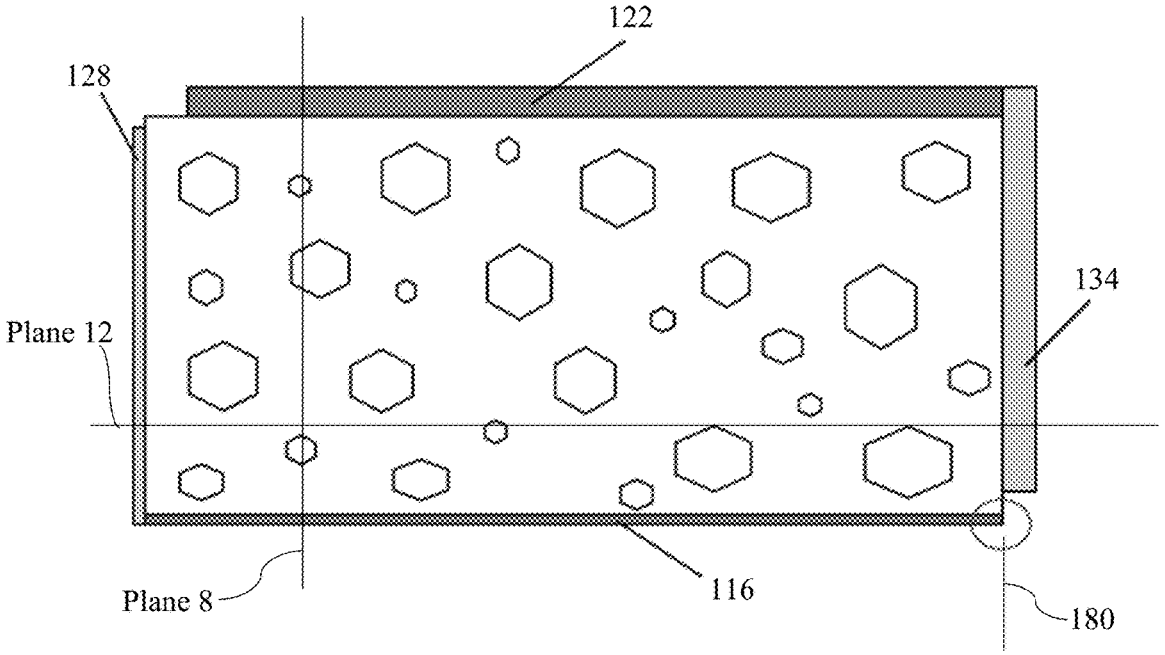
FIG. 11 is a front view of another exemplary panel in accordance with embodiments disclosed herein.
Figure 12A:
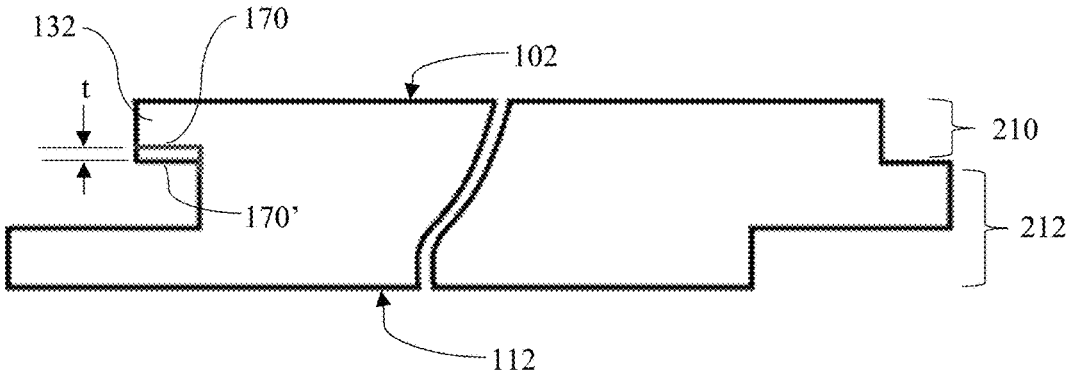
FIG. 12A is a cross sectional view of the panel of FIG. 11 in a plane 12, viewing downwardly along the page from above the plane 12.

Referring to FIGS. 8, 11, and 12A, according to a second embodiment of the panel 100, the first tongue 116 can extend at least to a plane 180 that is perpendicular to the first axis 90 and includes the fourth edge 110 of the face surface 102. The rear surface 170 of the second front leg 132 can be spaced from the rear surface 164 of the first front leg 120 relative to the third axis 94 by a tab thickness in a direction toward the face surface 102 (shown as the spacing between the rear surface 170 of the second front leg 132 and a conventional position 170' of the rear surface of second front leg 132). Accordingly, the first front leg 120 can have a thickness (relative to the third axis 94) that is greater than the thickness of the second front leg 132.

FIG. 12B illustrates a comparison of the cross section of FIG. 8 and the cross section of FIG. 12A with reference planes at various distances from the face surface 102 relative to the third axis 94. As can be seen, the rear surface 170 of the second front leg 132 is spaced closer to the face surface 102 than the rear surface 164 of the first front leg 120.

Figure 13:
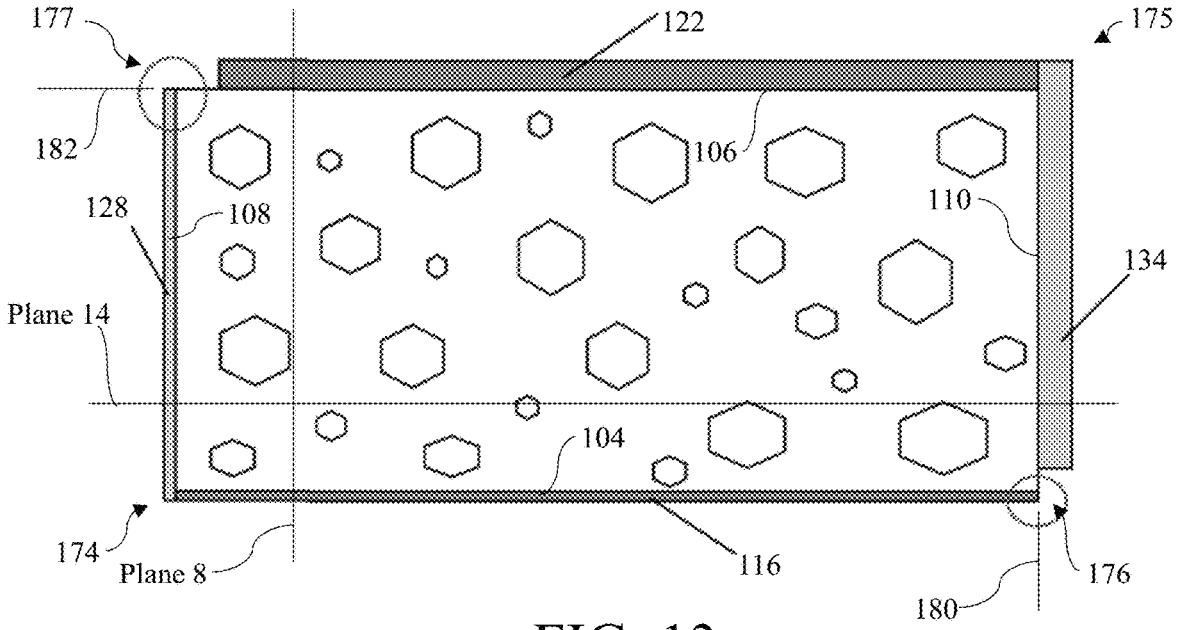
FIG. 13 is a front view of yet another exemplary panel in accordance with embodiments disclosed herein.

Referring to FIG. 8 (showing a cross section of the panel in plane 8 of FIG. 13), 13, and 14A (showing a cross section of the panel in plane 14 in FIG. 13), according to a third embodiment of the panel 100, the first tongue 116 can extend at least to a plane 180 that is perpendicular to the first axis 90 and includes the fourth edge 110 of the face surface 102, and the second tongue 128 can extend at least to a plane 182 that is perpendicular to the second axis 92 and includes the second edge 106 of the face surface 102. The rear surface 170 of the second front leg 132 can be spaced from the rear surface 164 of the first front leg 120 relative to the third axis 94 by a tab thickness in a direction toward the face surface 102 (shown as the spacing between the rear surface 164 of the second front leg 132 and the conventional position 164' of the rear surface). Additionally, the forward surface 166 of the second tongue 128 can be spaced from the forward surface 160 of the first tongue 116 relative to the third axis 94 in a direction toward the face surface 102 (shown as the spacing between the forward surface 166 of the second tongue 128 and a conventional position 166' of the forward surface).

Figure 14B:
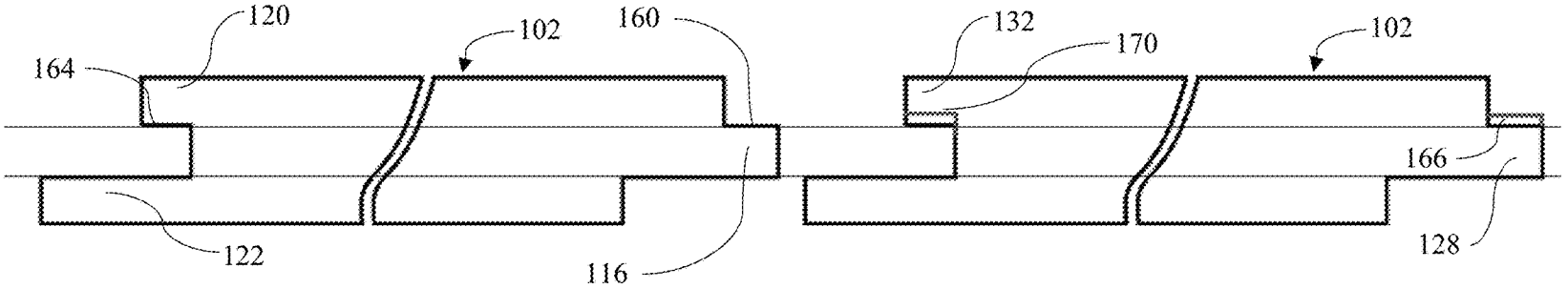
FIG. 14B is a comparison of the cross sections of FIGS. 8 and 14A with reference lines to show spacing of various surfaces.
Figure 14A:
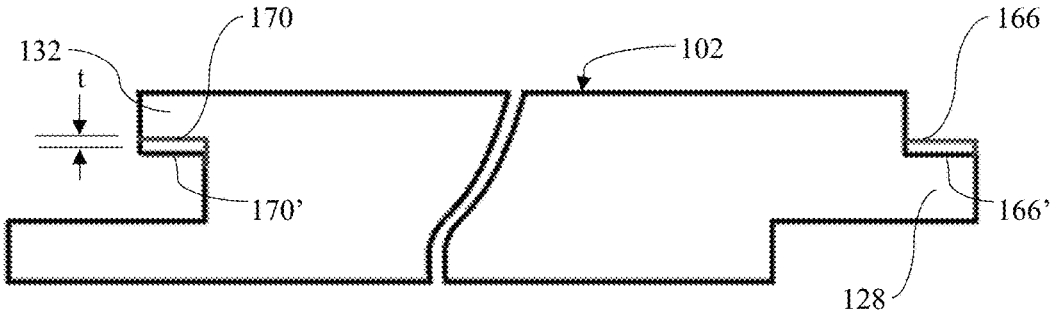
FIG. 14A is a cross sectional view of the panel of FIG. 13 in a plane 14, viewing downwardly along the page from above the plane 14.

FIG. 14B illustrates a comparison of the cross section of FIG. 8 and the cross section of FIG. 14A with reference planes at various distances from the face surface 102 relative to the third axis 94. As can be seen, the rear surface 170 of the second front leg 132 is spaced closer to the face surface 102 than the rear surface 164 of the first front leg 170, and the forward surface 166 of the second tongue 128 is spaced closer to the face surface 102 than the forward surface 160 of the first tongue 116. Accordingly, the first back leg 122 can have a thickness (relative to the third axis 94) that is less than the thickness of the second back leg 134, and the first tongue 116 can have a thickness that is greater than the thickness of the second tongue 128.

Figure 15:
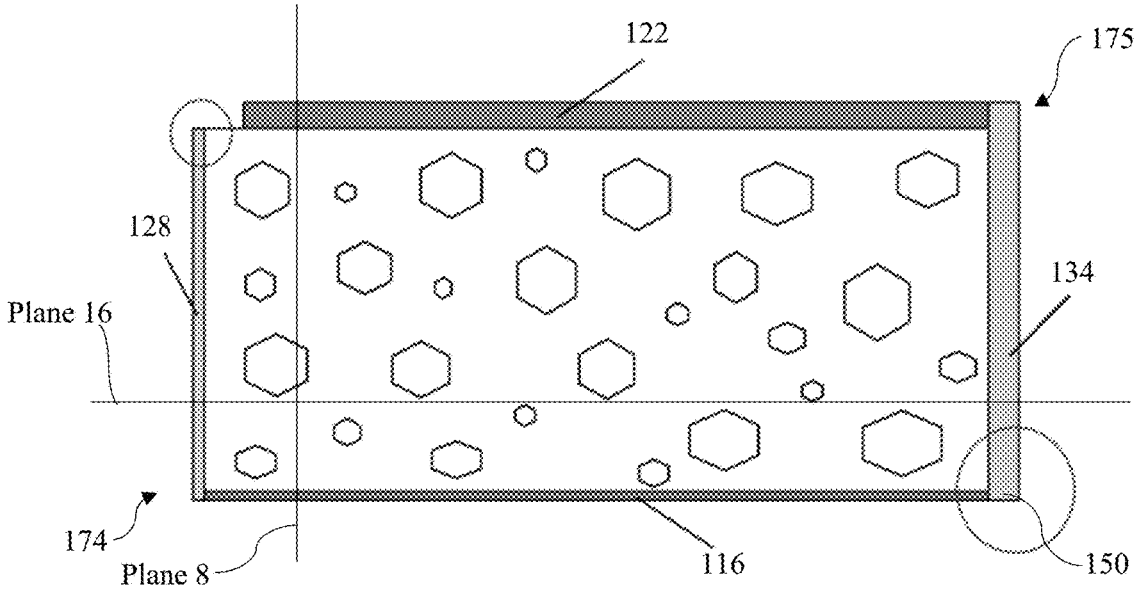
FIG. 15 is a front view of another exemplary panel in accordance with embodiments disclosed herein.

Referring to FIG. 8 (showing a cross section of the panel in plane 8 of FIG. 15), 15, and 16A (showing a cross section of the panel of FIG. 15 taken in plane 16), in a fourth embodiment of the panel 100, the second back leg 134 can extend beyond the first edge 104 of the face surface 102 by the same distance that the first tongue 116 extends from the first edge 104 of the face surface 102 (i.e., the first tongue width). Alternatively, the first tongue 116 can extend beyond the fourth edge 110 of the face surface 102 by distance substantially similar to the width of the second back leg 134, or, in other words, the first tongue 116 and the second back leg 134 can intersect at a first tab 150 (similar to FIG. 7) Additionally, the second tongue 128 can extend at least to the plane 182 that is perpendicular to the second axis 92 and includes the second edge 106 of the face surface 102 that is perpendicular to the second axis 92 and includes the second edge 106 of the face surface 102.

One way to form the fourth embodiment of the panel is to offset each of the forward surface 166 and rear surface 168 of the second tongue 128, the rear surface 170 of the second front leg 132, and the forward surface 172 of the second back leg 134 from their conventional positions by a tab thickness. That is, the forward surface 166 of the second tongue 128 can be spaced from the forward surface 160 of the first tongue 116 along the third axis 94 by a tab thickness in a direction toward the face surface 102 (shown as the spacing from the conventional position 166' of the forward surface). The rear surface 168 of the second tongue 128 can be spaced from the rear surface 162 of the first tongue 116 along the third axis 94 by the tab thickness in a direction toward the face surface 102 (shown as the spacing from the conventional position 168' of the rear surface). The rear surface 170 of the second front leg 132 can be spaced from the rear surface 164 of the first front leg 120 along the third axis 94 by the tab thickness in the direction toward the face surface 102 (shown as the spacing from the conventional position 164' of the rear surface). The forward surface 172 of the second back leg 134 can be spaced from the forward surface 165 of the first back leg 122 along the third axis 94 by the tab thickness in the direction toward the face surface 102 (shown as the spacing from the conventional position 165' of the forward surface). In some example embodiments, the forward surface 166 and rear surface 168 of the second tongue 128, the rear surface 170 of the second front leg 132, and the forward surface 172 of the second back leg 134 may be offset from their conventional positions either by different thicknesses or a single thickness.

Figure 16A:
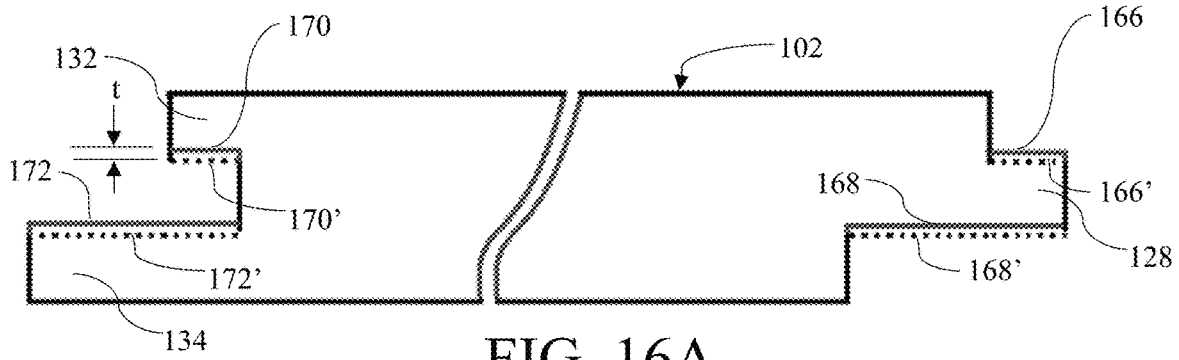
FIG. 16A is a cross sectional view of the panel of FIG. 15 in a plane 16, viewing downwardly along the page from above the plane 16. Dimensions are provided as optional, non-limiting aspects.
Figure 16B:
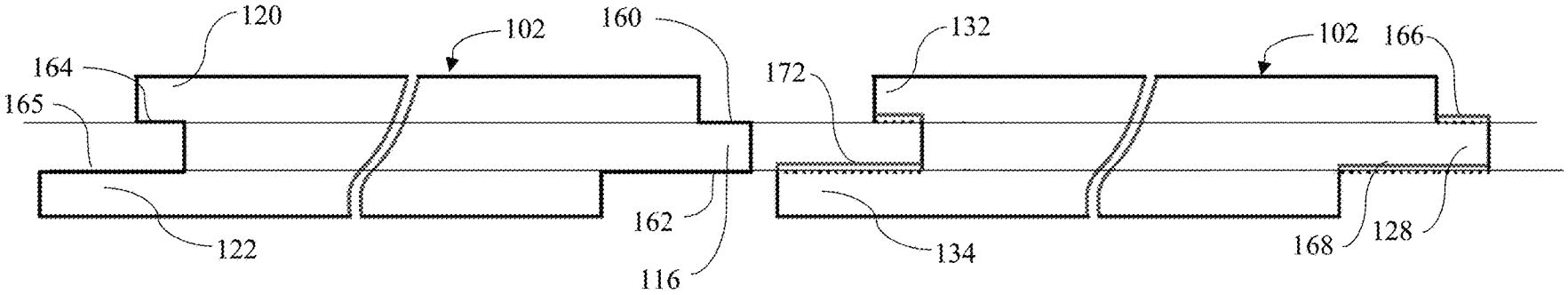
FIG. 16B is a comparison of the cross sections of FIGS. 8 and 16A with reference lines to show spacing of various surfaces. Dimensions are provided as optional, non-limiting aspects.

FIG. 16B illustrates a comparison of the cross section of FIG. 8 and the cross section of FIG. 16A with reference planes at various distances from the face surface 102 relative to the third axis 94. As can be seen, the rear surface 170 of the second front leg 132 is spaced closer to the face surface 102 than the rear surface 164 of the first front leg 120, and the forward surface 166 of the second tongue 128 is spaced closer to the face surface 102 than the forward surface 160 of the first tongue 116. Further, the forward surface 172 of the second back leg 134 is spaced flosser to the face surface 102 than the forward surface 165 of the first back leg 122, and the rear surface 168 of the second tongue 128 is spaced closer to the face surface 102 than the rear surface 162 of the first tongue 116.

Referring to FIG. 8 (showing a cross section of the panel of FIG. 17 in plane 8, 17, and 18A (showing a cross section of the panel of FIG. 17 taken in plane 18), in a fifth embodiment of the panel 100, the second tongue 128 can extend away from the third edge 108 of the face surface 102 by the second tongue width w3 along the first axis 90. The first back leg 122 can extend beyond the third edge 108 of the face surface 102 in a direction away from the fourth edge 110 of the face surface 102 by the second tongue width w3. Alternatively, the second tongue 128 can extend beyond the second edge 106 of the face surface 102 by distance substantially similar to the width of the first back leg 122, or in other words the second tongue 128 and the first back leg 122 can intersect at a second tab 152.

One way to form the fifth embodiment of the panel is to offset each of rear surface 168 of the second tongue 128 and the forward surface 172 of the second back leg 134. That is, the rear surface 168 of the second tongue 128 can be spaced from the rear surface 162 of the first tongue 116 along the third axis 94 by a tab thickness in a direction away from the face surface 102 (shown as the spacing from the conventional position 162' of the rear surface), and the forward surface 172 of the second back leg 134 is spaced from the forward surface 165 of the first back leg 122 along the third axis 94 by the tab thickness in the direction away from the face surface 102 (shown as the spacing from the conventional position 172' of the forward surface).

Figure 18B:
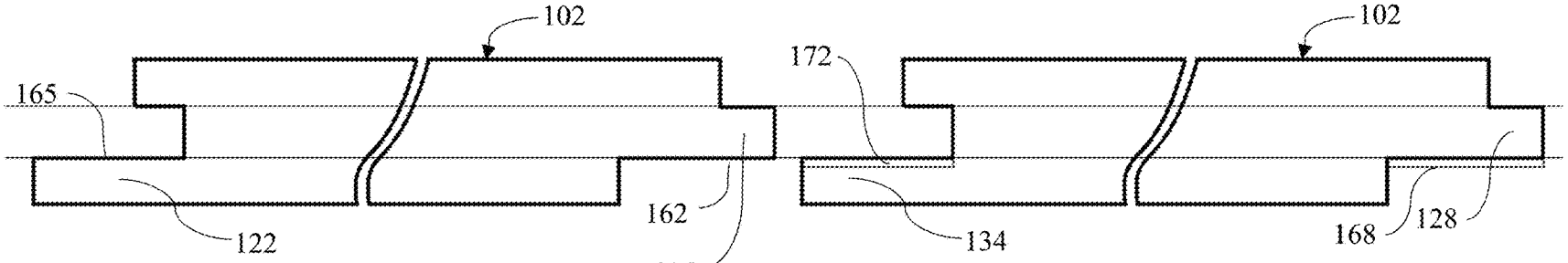
FIG. 18B is a comparison of the cross sections of FIGS. 8 and 18A with reference lines to show spacing of various surfaces.
Figure 18A:
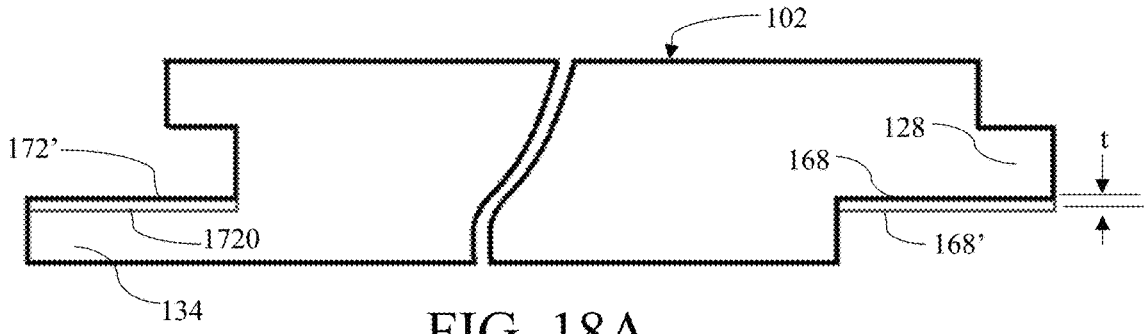
FIG. 18A is a cross sectional view of the panel of FIG. 17 in a plane 18, viewing downwardly along the page from above the plane 18.

FIG. 18B illustrates a comparison of the cross section of FIG. 8 and the cross section of FIG. 18A with reference planes at various distances from the face surface 102 relative to the third axis 94. As can be seen, the forward surface 172 of the second back leg 134 is spaced farther from the face surface 102 than the forward surface 165 of the first back leg 122, and the rear surface 168 of the second tongue 128 is spaced farther from the face surface 102 than the rear surface 162 of first tongue 116.

According to various aspects, the first tongue 116 and the second tongue 128 are joint at one end 174 such that the first tongue 116 extends past the third edge 108 by a distance of the second tongue width w3 at said one end thereof and the second tongue extends past the first edge 102 by a distance of the first tongue width w1 at said one end 174 thereof. In further aspects, the first back leg 122 and the second back leg 134 are joint at one end 175 such that the first back leg extends past the fourth edge 110 by a distance of a portion of the second back leg width w2 that extends beyond the second front leg at said one end thereof and the second back leg extends past the second edge 106 by a distance of a portion of the first back leg width w4 that extends beyond the first front leg at said one end 175 thereof.

In some aspects, and as shown in FIGS. 7, 11, 13, 15, and 17, an opposite end of at least one of the first tongue 116, the second tongue 128, the first back leg 122, and the second back leg 134 extends till the fourth edge 110, the second edge 106, third edge 108, and the first edge 104 respectively. For example, as shown in FIG. 13, an opposite end 176 of the first tongue 116 can extend to the fourth edge 110, and an opposite end 177 of the second tongue 128 can extend to the second edge 106. In further aspects, an opposite end of at least one of the first tongue 116, the second tongue 128, the first back leg 122, and the second back leg 134 extends past the fourth edge 110, the second edge 106, third edge 108, and the first edge 104 respectively and by a distance less than the second back leg width, the first back leg width, the second tongue width, and the first tongue width respectively. In further aspects, and as shown, for example, in FIGS. 7, 15, and 17 an opposite end of one of the first tongue 116, the second tongue 128, the first back leg 122, and the second back leg 134 extends past the fourth edge 110, the second edge 106, third edge 108, and the first edge 104 respectively and by a distance substantially equal to a portion of the second back leg width that extends beyond the second front leg, a portion of the first back leg width that extends beyond the first front leg, the second tongue width, and the first tongue width, respectively.

Even though it is not shown in the figures or different embodiments described herein, the opposite ends of the first and second tongues 116, 128 and the first and second back legs 122, 134 of the panel 100 may not extend all the way to the edges (110, 106, 108, 104), respectively, but may still be longer than the respective faces (104, 108, 106, 110) from which they protrude out. In said example, there may be gaps between the edges (110, 106, 108, 104) and tongues (116, 128) and back legs (122, 134), respectively. Said gaps may be covered by the extensions of the tongues (116, 128) and/or back legs (122, 134) of adjacent interlocked panels 100.

Figure 19:
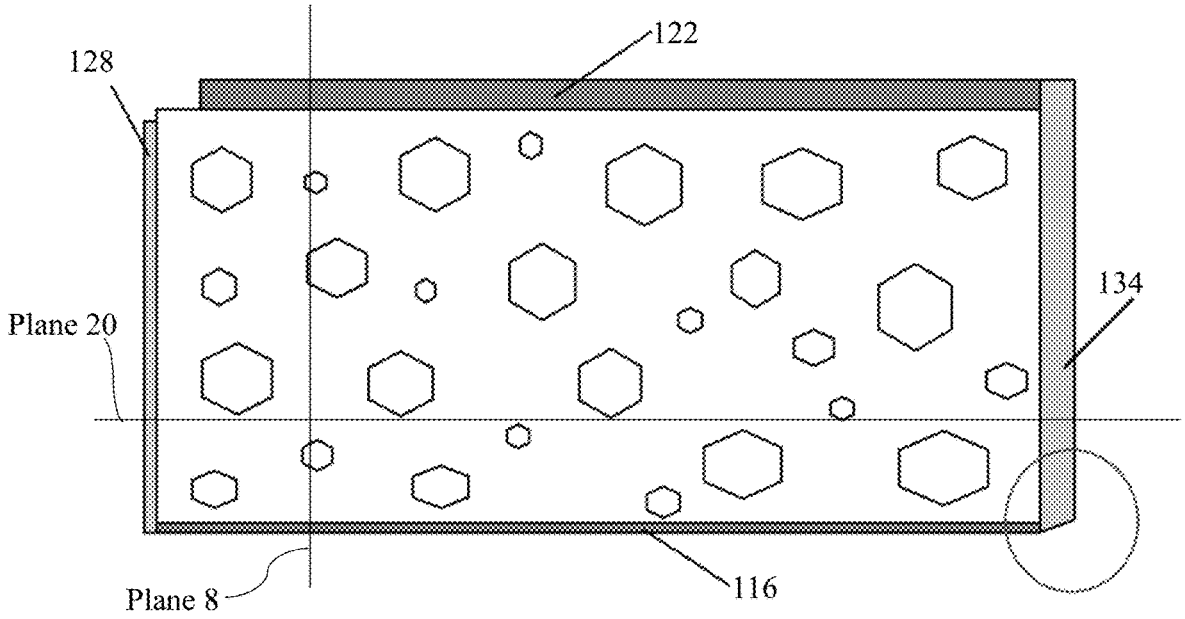
FIG. 19 is a front view of another exemplary panel in accordance with embodiments disclosed herein.
Figure 20:
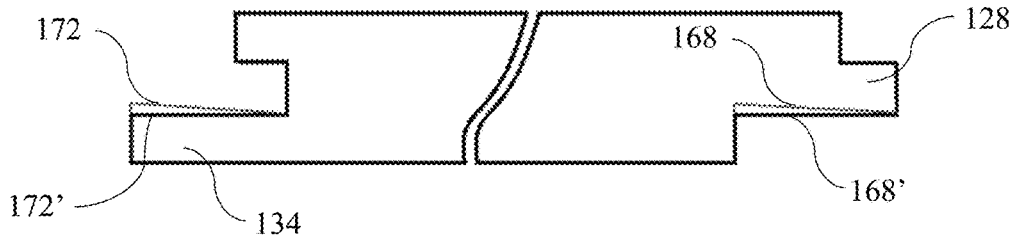
FIG. 20 is a cross sectional view of the panel of FIG. 19 in a plane 20, viewing downwardly along the page from above the plane 20.

Referring to FIG. 8 (showing a cross section of the panel of FIG. 19 in plane 8), 19, and 20 (showing a cross section of the panel of FIG. 19 taken in plane 20), it is contemplated that the respective forward and rear surfaces of the first and second tongues (116, 128) and the first and second front and back legs (122, 134) need not be parallel. For example, in some optional aspects, each of the forward surface 165 of the first back leg 122, the forward surface 172 of second back leg 134, the rear surface 162 of the first tongue 116, and the rear surface 168 of the second tongue 128 can be planar. The forward surface 165 of the first back leg 122 can be oriented at an acute angle with respect to forward surface 172 of the second back leg 134, and the rear surface 168 of the second tongue 128 can be oriented at an acute angle with respect to the rear surface 162 of the first tongue 116. For example, FIG. 20 illustrates the forward surface 172 of second back leg 134 and the rear surface 168 of the second tongue 128 that are angularly offset from their respective conventional surfaces 172', 168' and forming an acute angle with the face surface 102. In this way, adjacent panels 100 can be joined in an interlocking fashion. Further, it is contemplated that milling tools that form the said surfaces can be allowed to be angularly offset within a tolerance without inhibiting performance. It is further contemplated that the first and second tongues and the first and second back legs need not be rectangular in cross sections in planes perpendicular to the third axis 94. For example, the first tongue and second back leg can meet at a chamfered corner. It is contemplated that forming said surfaces with the angular offset can provide the chamfered corner as shown in FIG. 19.

Figure 21:
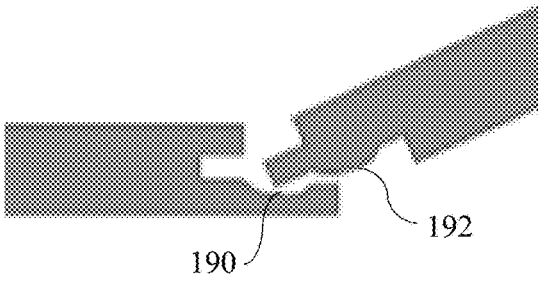
FIG. 21 is a cross sectional view of exemplary panels having locking elements in accordance with embodiments disclosed herein.
Figure 22:
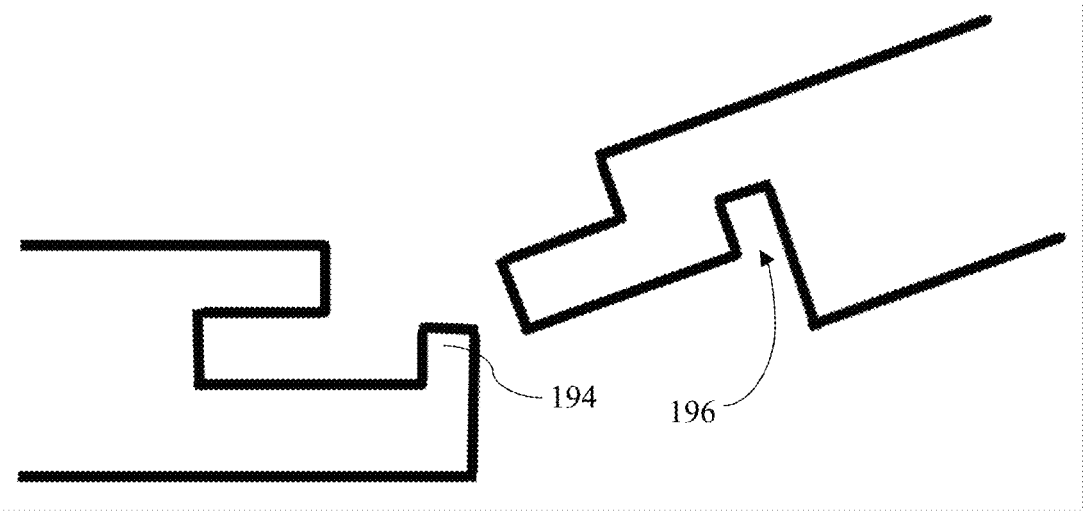
FIG. 22 is a cross sectional view of further exemplary panels having locking elements.

Referring to FIGS. 21 and 22, although a majority of the disclosed embodiments have generally rectangular tongues and corresponding grooves (in planes perpendicular to the longitudinal dimensions of the tongues and grooves), in various aspects, other interlocking features can be integrated within the profile of the tongue and groove. Such interlocking features can be referred to as click systems. For example, a back leg (e.g., the first back leg 122 or the second back leg 134) can define a recess 190 that receives a corresponding protrusion 192 of the rear surface of a corresponding tongue. In this way, in order to attach adjacent panels, the top leg must be deflected upwardly until the protrusion 192 is received within the recess, forming a locking union. In further aspects, the at least one back leg (e.g., the first back leg 122 or the second back leg 134) can define a hook 194 (e.g., a vertically extending distal portion) that is receivable into a complementarily shaped receptacle 196.

In various aspects, the material of the disclosed panels can be waterproof or water resistant. For example, the panels can comprise polymer (e.g., polyvinylchloride, polyethylene terephthalate, acrylonitrile butadiene styrene, polypropylene, or polyurethane). In further aspects, the panel can comprise wood-based materials such as plywood, solid wood or HDF. In still further aspects, the panel 100 can comprise fibercement, magnesium oxide (mineral core panels), chalk, or talc. In still further aspects, the panel can comprise one or more ceramic materials. In some aspects, the panel can comprise a face structure (e.g., a ceramic tile or other decorative layer, optionally including a coating) that is secured to a support structure that defines the tongue and groove configurations disclosed herein.

In exemplary aspects, and with reference to FIG. 12A, it is contemplated that the panels 100 disclosed herein can be characterized as having a face portion 210 that defines the face surface 102 of the panel and a back portion 212 that is connected to the face portion and that defines the back surface 112 of the panel. In these aspects, it is contemplated that the face portion 210 and the back portion 212 can cooperate to define the first, second, third, and fourth sides of the panel 100. It is further contemplated that the face portion can have a consistent peripheral profile (e.g., a consistent rectangular profile) extending between the face surface and the back portion such that the length and width of the face surface respectively correspond to a length and a width of the face portion. In contrast to the face portion, the back portion can have a variable profile along the third axis that defines: a projection (e.g., a tongue or a leg as disclosed herein) of the first side or the second side that has a longitudinal dimension along the first axis that is greater than the length of the face portion; and/or a projection (e.g., a tongue or a leg as disclosed herein) of the third side or the fourth side that has a longitudinal dimension along the second axis that is greater than the width of the face portion. In exemplary aspects, it is contemplated that the groove within a side of the disclosed panels can be formed by a projection and a surface of the face portion, with the groove being recessed relative to the face portion and the projection extending beyond the perimeter of the face portion.

Figure 23:
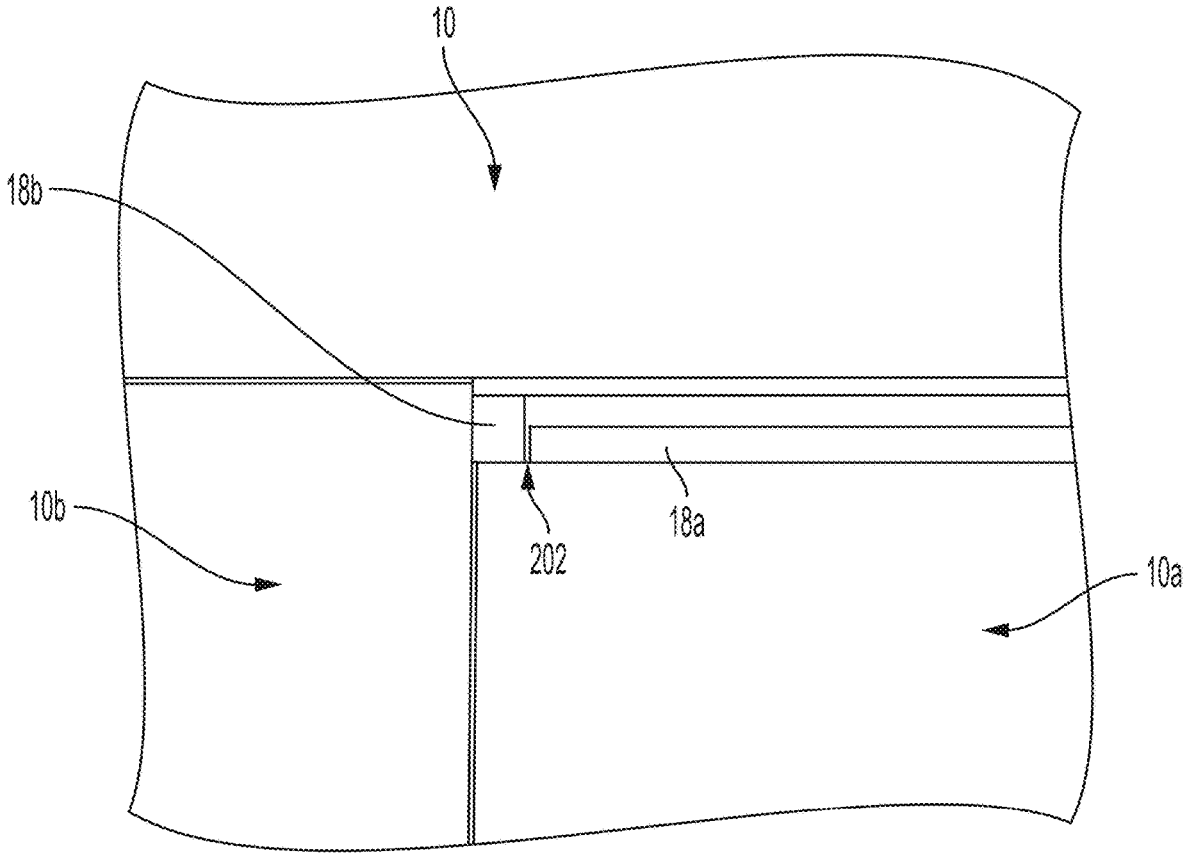
FIG. 23 is a front view of a system of conventional tongue and groove panels showing a gap between imperfectly abutting panels.
Figure 24:
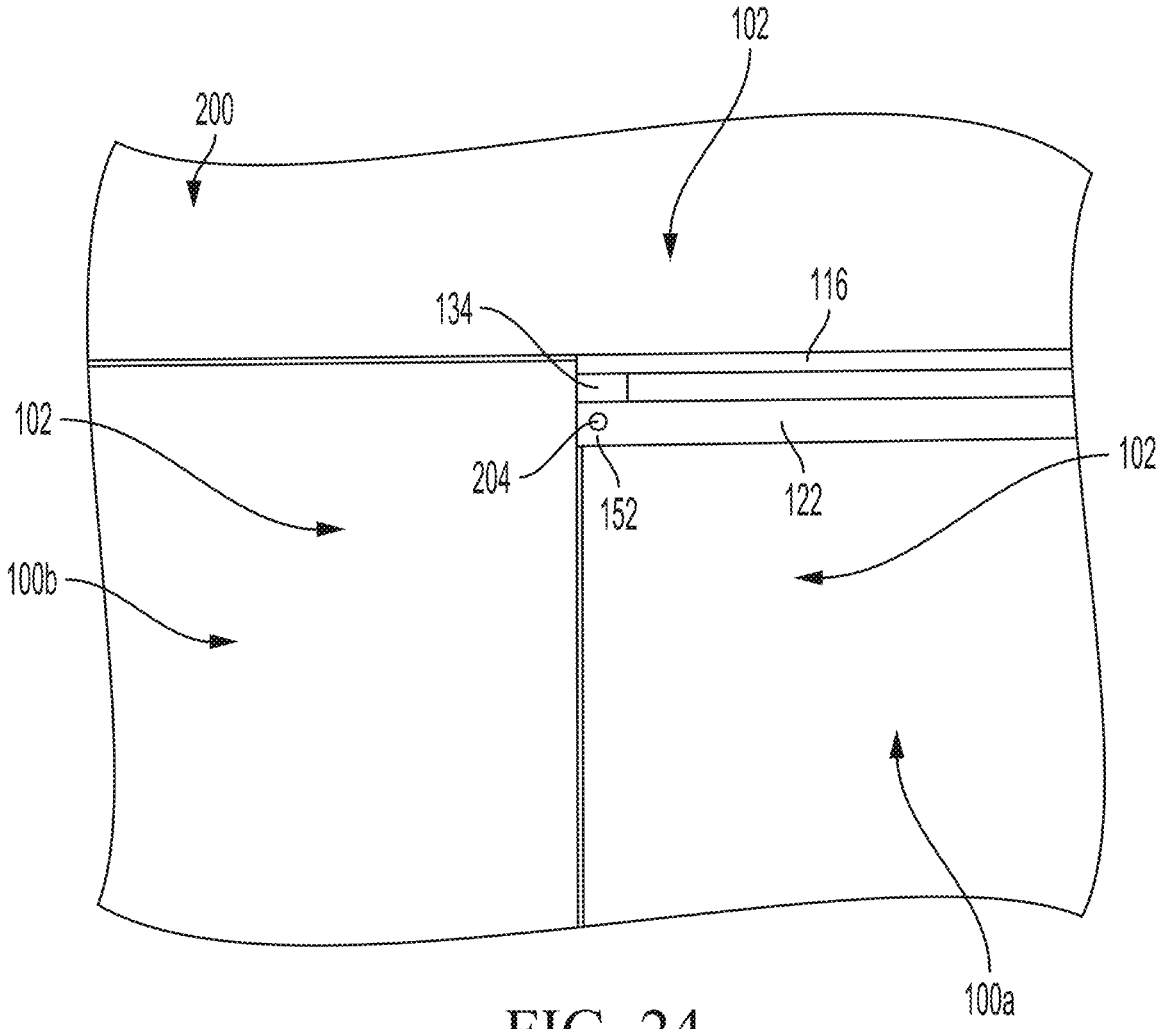
FIG. 24 is a front view of a system of panels in accordance with embodiments disclosed herein showing an absence of gaps between imperfectly abutting panels.

Referring to FIGS. 23 and 24, panels 100 (e.g., comprising a panel 100*a* and a panel 100*b*) can be assembled to form a system 200. As can be seen in FIG. 23, the conventional panels 10*a,b* of FIG. 23 do not allow overlapping between the back leg 18*a* of the first panel 10*a* and the back leg 18*b* of the second panel 10*b*, thereby defining a gap 202 therebetween. In contrast, as shown in FIG. 24, illustrating an application of fifth embodiment (FIG. 17), the first back leg 122 of the first panel 100*a* and the second back leg 134 of the second panel 100*b* can overlap (e.g., via the second tab 152) so that an axis 204 (shown extending into the page) that is parallel to the third axes 94 of the first and second panels extends through both of the first back leg 122 of the first panel 100*a* and the second back leg 134 of the second panel 100*b*. In this way, the overlapping portions can provide a fluid barrier, even when the face surfaces 102 are not tightly abutting each other. FIG. 24 is only an example arrangement of the panels 100*a* and 100*b* to illustrate the overlap that is created, and is not limiting. It is noted that any other appropriate arrangement of the panels 100 can be used to create the overlap without departing from a broader scope of the present disclosure.

Figure 25:
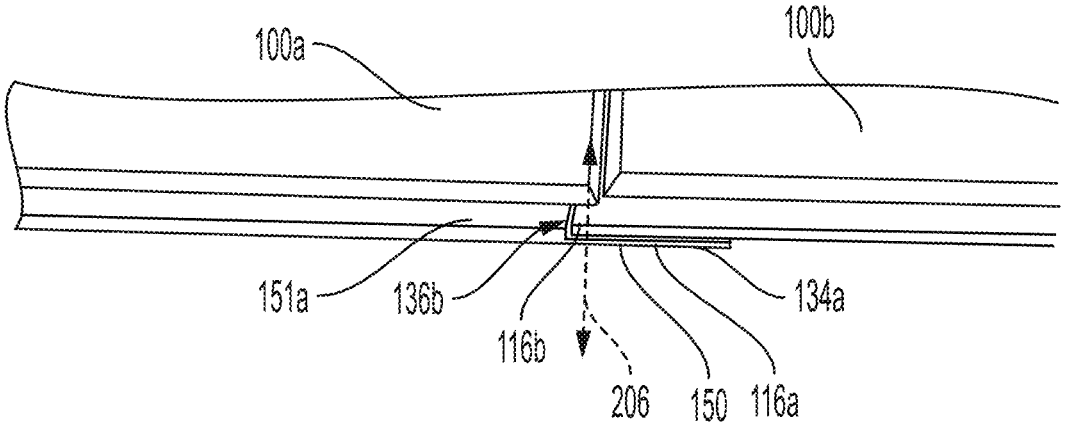
FIG. 25 is a perspective view of a pair of abutting panels in a panel system.

Referring to FIG. 25, showing an application of the first embodiment (FIG. 7), in further aspects, at least one of the first tongue 116*a* or the second tongue 128*a* of the first panel 100*a* can overlap a respective first tongue 116*b* or second tongue 128*b* of the second panel 100*b* so that an axis 206 that is parallel to the third axes of the first and second panels extends through both overlapping tongues of the first and second panels. In some example embodiments, the tongues (116 or 128) of one panel 100 may overlap with the back legs (122 or 134) of an adjacent interlocking panel 100. In certain example embodiments, panels 100 of the same embodiment (e.g., first (FIG. 7), second (FIG. 11), third (FIG. 13), fourth (FIG. 15), or fifth (FIG. 17)) may be interlocked with each other to form the overlap. In other example embodiments, panels of different embodiments may be interlocked to form the overlap. In other words, a panel as shown in FIG. 7 that is coupled or interlocked with an adjacent panel as shown in any of FIG. 9, 11, 13, or 15 may form the overlap between the respective tongues, grooves, or between tongues and grooves without departing from a broader scope of the present disclosure. As shown in FIG. 25, formation of the second groove 136 with the offsets of the forward and rear faces of the respective tongues and back legs relative to the third axis 94 (described herein with reference to FIGS. 8-9B) can form the first tab 150 (shown extending below the first tongue 116*b*) adjacent the main body portion 151*a* of the first tongue 116*a*. Accordingly, the tab 150 (i.e., the portion of the first tongue 116*a* beyond the main body portion 151*a* to the right in the page) can also be a portion of the second back leg 134*a*.

In some aspects, the panels 100 of the system 200 can have grout deposited therebetween. Optionally, one or more (optionally, all) of the first edge 104, the second edge 106, the third edge 108, and the fourth edge 110 of the face surface 102 can be beveled.

Embodiments disclosed herein can form surface coverings that inhibit water permeation without a need for silicone sealants. Although described herein as an option for use as a vertical wall covering in showers, embodiments disclosed herein can be used in various applications for any walls, floors, ceilings, or any suitable surface. The panels can be used for wet or dry surfaces and can be used to inhibit permeation of fluids other than water (e.g., oil). The panels can be provided in any orientation (horizontal, vertical, or diagonal). The panels can be inexpensively installed and can be effective when installed by inexperienced (e.g., DIY) users. The panels can allow for tolerance in subsurface flatness or roughness while still forming a surface covering that inhibits water permeation.

Because panel thicknesses are constrained by features such as weight and volume, the thickness of the tabs (e.g., the first tab 150 or the second tab 152) can be similarly constrained. It is contemplated that conventional panels avoid thin portions that might be subject to breaking during manufacturing, transportation, or installation. Accordingly, the panels as disclosed herein, which maintain the entire panel thickness while also thin extensions that do not easily break or chip off during transportation and installation, are a nonobvious deviation from conventional panels.

Exemplary Aspects

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A panel comprising: a face surface having: a first edge and a second edge that extend along a first axis and are spaced by a width along a second axis that is perpendicular to the first axis, and a third edge and a fourth edge that extend along the second axis and are spaced by a length along the first axis; a back surface spaced from the face surface along a third axis that is perpendicular to the first and second axes; a first side that extends between the first edge of the face surface and the back surface, wherein the first side comprises a first tongue; a second side that extends between the second edge of the face surface and the back surface, wherein the second side comprises a first front leg and a first back leg that cooperate to define a first groove therebetween; a third side that extends between the third edge of the face surface and the back surface, wherein the third side comprises a second tongue; and a fourth side that extends between the fourth edge of the face surface and the back surface, wherein the fourth side comprises a second front leg and a second back leg that cooperate to define a second groove, wherein: at least one of the first tongue or the first back leg has a longitudinal dimension along the first axis that is greater than the length of the face surface; or at least one of the second tongue or the second back leg has a longitudinal dimension along the second axis that is greater than the width of the face surface.

Aspect 2: The panel of aspect 1, wherein at least one of the first tongue or the first back leg has a longitudinal dimension along the first axis that is greater than the length of the face surface, and at least one of second tongue or the second back leg has a longitudinal dimension along the second axis that is less than the width of the face surface.

Aspect 3: The panel of aspect 1 or aspect 2, wherein: at least one of the first tongue or the first back leg has a longitudinal dimension along the first axis that is greater than the length of the face surface by at least 0.2 mm, or at least one of the second tongue or the second back leg has a longitudinal dimension along the second axis that is greater than the width of the face surface by at least 0.2 mm.

Aspect 4: The panel of any one of aspects 1-4, wherein the first tongue extends away from the first edge of the face surface by a select distance along the second axis, wherein the second back leg extends beyond the first edge of the face surface in a direction away from the second edge of the face surface by the select distance.

Aspect 5: The panel of aspect 4, wherein the first tongue has a forward surface and a rear surface, wherein the second tongue has a forward surface and a rear surface, wherein the rear surface of the second tongue is spaced from the rear surface of the first tongue along the third axis by a tab thickness in a direction toward the face surface, and wherein each of the first back leg and the second back leg has a forward surface and a rear surface, wherein the forward surface of the second back leg is spaced from the forward surface of the first back leg along the third axis by the tab thickness in a direction toward the face surface.

Aspect 6: The panel of any one of aspects 1-5, wherein the first tongue extends at least to a plane that is perpendicular to the first axis and includes the fourth edge of the face surface.

Aspect 7: The panel of aspect 6, wherein each of the first and second front legs defines a rear surface that is spaced from the face surface along the third axis, wherein the rear surface of the second front leg is spaced from the rear surface of the first front leg relative to the third axis by a tab thickness in a direction toward the face surface.

Aspect 8: The panel of aspect 6 or aspect 7, wherein the second tongue extends at least to a plane that is perpendicular to the second axis and includes the fourth edge of the face surface.

Aspect 9: The panel of aspect 8, wherein each of the first and second front legs defines a rear surface that is spaced from the face surface along the third axis, wherein the rear surface of the second front leg is spaced from the rear surface of the first front leg along the third axis by a tab thickness in a direction toward the face surface, and wherein each of the first tongue and the second tongue has a forward surface and a rear surface, wherein the forward surface of the second tongue is spaced from the forward surface of the first tongue along the third axis by the tab thickness in a direction toward the face surface.

Aspect 10: The panel of aspect 4, wherein the second tongue extends at least to a plane that is perpendicular to the second axis and includes the second edge of the face surface.

Aspect 11: The panel of aspect 10, wherein each of the first tongue and the second tongue has a forward surface and a rear surface, wherein the forward surface of the second tongue is spaced from the forward surface of the first tongue along the third axis in a direction toward the face surface, wherein the rear surface of the second tongue is spaced from the rear surface of the first tongue along the third axis by a tab thickness in a direction toward the face surface, wherein each of the first and second front legs defines a rear surface that is spaced from the face surface relative to the third axis, wherein the rear surface of the second front leg is spaced from the rear surface of the first front leg along the third axis by the tab thickness in the direction toward the face surface, and wherein each of the first back leg and the second back leg has a forward surface and a rear surface that is spaced from the forward surface along the third axis, wherein the forward surface of the second back leg is spaced from the forward surface of the first back leg along the third axis by the tab thickness in the direction toward the face surface.

Aspect 12: The panel of any one of the preceding aspects, wherein the second tongue extends away from the third edge of the face surface by a select distance along the first axis, wherein the first back leg extends beyond the third edge of the face surface in a direction away from the fourth edge of the face surface by the select distance.

Aspect 13: The panel of aspect 12, wherein each of the first tongue and the second tongue has a forward surface and a rear surface, wherein the rear surface of the second tongue is spaced from the rear surface of the first tongue along the third axis in a direction away from the face surface, and wherein each of the first back leg and the second back leg has a forward surface and a rear surface that is spaced from the forward surface along the third axis, wherein the forward surface of the second back leg is spaced from the forward surface of the first back leg along the third axis by the tab thickness in the direction away from the face surface.

Aspect 14: The panel of any one of the preceding aspects, wherein the tab thickness is between 0.2 mm and 5 mm.

Aspect 15: The panel of any one of the preceding aspects, wherein each of the first front leg and the first back leg has a width relative to the second dimension, wherein the width of the first back leg is greater than the width of the first front leg.

Aspect 16: The panel of any one of the preceding aspects, wherein each of the second front leg and the second back leg has a width relative to the second dimension, wherein the width of the second back leg is greater than the width of the second front leg.

Aspect 17: The panel of any one of the preceding aspects, wherein the first tongue and second back leg intersect at a first tab, wherein the first tongue has a rear surface, wherein the second back leg has a forward surface, wherein the first tab is at least partially defined by the rear surface of the first tongue and the forward surface of the second back leg.

Aspect 18: The panel of aspect 17, wherein the rear surface of the first tongue and the forward surface of the second back leg are offset by a first tab thickness of between 0.2 mm and 5 mm.

Aspect 19: The panel of any one of the preceding aspects, wherein the second tongue and first back leg intersect at a second tab, wherein the second tongue has a rear surface, wherein the first back leg has a forward surface, wherein the second tab is at least partially defined by the rear surface of the second tongue and the forward surface of the first back leg.

Aspect 20: The panel of aspect 19, wherein the rear surface of the first tongue and a forward surface of the second back leg are offset by a second tab thickness of between 0.2 mm and 5 mm.

Aspect 21: The panel of any one of the preceding aspects, wherein at least one of the first, second, third, or fourth edges of the face surface is beveled.

Aspect 22: The panel of any one of the preceding aspects, wherein each of the first back leg and the second back leg has a planar forward surface, wherein each of the first tongue and the second tongue has a planar rear surface, wherein the forward surface of the first back leg is oriented at an acute angle with respect to the rear surface of the first tongue, and wherein the forward surface of the second back leg is oriented at an acute angle with respect to the rear surface of the second tongue.

Aspect 23: A surface covering comprising: at least a first and second panels as recited in any one of the preceding aspects, wherein at least one of the first tongue or the second tongue of the first panel overlaps a respective first tongue or second tongue of the second panel so that an axis that is parallel to the third axes of the first and second panels extends through both overlapping tongues of the first and second panels.

Aspect 24: The surface covering of aspect 23, further comprising grout between the first panel and the second panel.

Aspect 25: A panel comprising: a face portion defining a face surface of the panel; and a back portion connected to the face portion and defining a back surface of the panel, wherein the face portion and the back portion cooperate to define: opposing first and second sides of the panel that extend along a first axis and are spaced apart along a second axis that is perpendicular to the first axis; and opposing third and fourth sides of the panel that extend between the first and second sides along the second axis and are spaced apart along the first axis, wherein the face surface has: a first edge and a second edge that extend along the first axis and are spaced by a width along the second axis; and a third edge and a fourth edge that extend along the second axis and are spaced by a length along the first axis, wherein the back surface is spaced from the face surface along a third axis that is perpendicular to the first and second axes, wherein the face portion has a consistent peripheral profile extending between the face surface and the back portion such that the length and width of the face surface respectively correspond to a length and a width of the face portion, wherein the back portion has a variable profile along the third axis that defines: a projection of the first side or the second side that has a longitudinal dimension along the first axis that is greater than the length of the face portion; or a projection of the third side or the fourth side that has a longitudinal dimension along the second axis that is greater than the width of the face portion.

Aspect 26: The panel of aspect 25, wherein the back portion defines a tongue on the first side of the panel that is greater than the length of the face portion.

Aspect 27: The panel of aspect 25 or aspect 26, wherein the back portion defines a leg that defines a portion of a groove on the second side of the panel that is greater than the length of the face portion.

Aspect 28: The panel of any one of aspects 25-27, wherein the back portion defines a tongue on the third side of the panel that is greater than the width of the face portion.

Aspect 29: The panel of any one of aspects 25-28, wherein the back portion defines a leg that defines a portion of a groove on the fourth side of the panel that is greater than the width of the face portion.

Aspect 30: A surface covering comprising: at least a first and second panels as recited in any one of aspects 25-29, wherein at least one projection of the first panel overlaps a respective projection of the second panel so that an axis that is parallel to the third axes of the first and second panels extends through both overlapping projections of the first and second panels.

Aspect 31: A panel comprising: a body portion having a length, a width, and a thickness, the body comprising: a first face; a second face disposed opposite to the first face and spaced apart by the thickness; a first side extending from a first edge of the first face to a first edge of the second face; a second side disposed opposite to the first side and extending from a second edge of the first face to a second edge of the second face, the second side and the first side spaced apart by the width along a first axis; a third side extending from a third edge of the first face to a third edge of the second face; and a fourth side disposed opposite to the third side and extending from a fourth edge of the first face to a fourth edge of the second face, the third side and the fourth side spaced apart by the length along a second axis that is perpendicular to the first axis; a first tongue disposed at the first side and extending away from the second side, the first tongue having a first tongue length and the first tongue width; a first groove defined by a pair of first front leg and first back leg disposed at the second side and extending away from the first side, the first back leg having a first back leg length and a first back leg width; a second tongue disposed at the third side and extending away from the fourth side, the second tongue having a second tongue length and a second tongue width; and a second groove defined by a pair of second front leg and second back leg disposed at the fourth side and extending away from the third side, the second back leg having a second back leg length and a second back leg width, wherein: at least one of the first tongue length of the first tongue and the first back leg length of the first back leg extend along the second axis and is greater than the length of the body portion; or at least one of the second tongue length of the second tongue and the second back leg length of the second back leg extend along the first axis and is greater than the width of the body portion.

Aspect 32: The panel of aspect 31, wherein the first tongue and the second tongue are joint at one end such that the first tongue extends past the third side by a distance of the second tongue width at said one end thereof and the second tongue extends past the first side by a distance of the first tongue width at said one end thereof; and the first back leg and the second back leg are joint at one end such that the first back leg extends past the fourth side by a distance of the second back leg width at said one end thereof and the second back leg extends past the second side by a distance of the first back leg width at said one end thereof.

Aspect 33: The panel of aspect 31, wherein an opposite end of one of the first tongue, the second tongue, the first back leg, and the second back leg extends till the fourth side, the second side, third side, and the first side respectively.

Aspect 34: The panel of aspect 31, wherein an opposite end of one of the first tongue, the second tongue, the first back leg, and the second back leg extends past the fourth side, the second side, third side, and the first side respectively and by a distance less than the second back leg width, the first back leg width, the second tongue width, and the first tongue width respectively.

Aspect 35: The panel of aspect 31, wherein an opposite end of one of the first tongue, the second tongue, the first back leg, and the second back leg extends past the fourth side, the second side, third side, and the first side respectively and by a distance equal to the second back leg width, the first back leg width, the second tongue width, and the first tongue width respectively.

Aspect 36: The panel of aspect 31, wherein an opposite end of at least one of the first tongue, the second tongue, the first back leg, and the second back leg extends till the fourth side, the second side, third side, and the first side respectively.

Aspect 37: The panel of aspect 31, wherein an opposite end of at least one of the first tongue, the second tongue, the first back leg, and the second back leg extends past the fourth side, the second side, third side, and the first side respectively and by a distance less than the second back leg width, the first back leg width, the second tongue width, and the first tongue width respectively.

Aspect 38: The panel of aspect 31, wherein an opposite end of at least one of the first tongue, the second tongue, the first back leg, and the second back leg extends past the fourth side, the second side, third side, and the first side respectively and by a distance equal to the second back leg width, the first back leg width, the second tongue width, and the first tongue width respectively.

Aspect 39: The panel of aspect 31, wherein the first tongue has a first tongue thickness and the second tongue has a second tongue thickness, and wherein the first back leg has a first back leg thickness, the first front leg has a first front leg thickness, the second back leg has a second back leg thickness, and the second front leg has a second front leg thickness.

Aspect 40: The panel of aspect 39, wherein an opposite end of the second back leg extends past the first side and an opposite end of the first tongue extends past the fourth side such the second back leg and the first tongue join at a corner defined by the first side and the fourth side, wherein the second back leg is configured such that the second back leg thickness is greater than the first back leg thickness of the first back leg by a first tab thickness, and wherein the second tongue is configured such that the second tongue thickness is lesser than the first tongue thickness.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A unitary panel comprising:

a face surface having:

a first edge and a second edge that extend along a first axis and are spaced by a width along a second axis that is perpendicular to the first axis, and a third edge and a fourth edge that extend along the second axis and are spaced by a length along the first axis;

a back surface spaced from the face surface along a third axis that is perpendicular to the first and second axes;

a first side that extends between the first edge of the face surface and the back surface, wherein the first side comprises a first tongue;

a second side that extends between the second edge of the face surface and the back surface, wherein the second side comprises a first front leg and a first back leg that cooperate to define a first groove therebetween;

a third side that extends between the third edge of the face surface and the back surface, wherein the third side comprises a second tongue; and a fourth side that extends between the fourth edge of the face surface and the back surface, wherein the fourth side comprises a second front leg and a second back leg that cooperate to define a second groove, wherein:

at least one of the first tongue or the first back leg has a longitudinal dimension along the first axis that is greater than the length of the face surface; or at least one of the second tongue or the second back leg has a longitudinal dimension along the second axis that is greater than the width of the face surface, wherein the first tongue extends at least to a plane that is perpendicular to the first axis and includes the fourth edge of the face surface, and wherein the second tongue extends at least to a plane that is perpendicular to the second axis and includes the second edge of the face surface.

2. The unitary panel of claim 1, wherein each of the first and second front legs defines a rear surface that is spaced from the face surface along the third axis, wherein the rear surface of the second front leg is spaced from the rear surface of the first front leg along the third axis by a tab thickness in a direction toward the face surface, and wherein each of the first tongue and the second tongue has a forward surface and a rear surface, and wherein the forward surface of the second tongue is spaced from the forward surface of the first tongue along the third axis by the tab thickness in a direction toward the face surface.

3. A unitary panel comprising:

a face surface having:

a first edge and a second edge that extend along a first axis and are spaced by a width along a second axis that is perpendicular to the first axis, and a third edge and a fourth edge that extend along the second axis and are spaced by a length along the first axis;

a back surface spaced from the face surface along a third axis that is perpendicular to the first and second axes;

a first side that extends between the first edge of the face surface and the back surface, wherein the first side comprises a first tongue;

a second side that extends between the second edge of the face surface and the back surface, wherein the second side comprises a first front leg and a first back leg that cooperate to define a first groove therebetween;

a third side that extends between the third edge of the face surface and the back surface, wherein the third side comprises a second tongue; and a fourth side that extends between the fourth edge of the face surface and the back surface, wherein the fourth side comprises a second front leg and a second back leg that cooperate to define a second groove, wherein:

at least one of the first tongue or the first back leg of the has a longitudinal dimension along the first axis that is greater than the length of the face surface; or at least one of the second tongue or the second back leg has a longitudinal dimension along the second axis that is greater than the width of the face surface, wherein each of the first back leg and the second back leg has a planar forward surface, wherein each of the first tongue and the second tongue has a planar rear surface, wherein the forward surface of the first back leg is oriented at an acute angle with respect to the rear surface of the first tongue, and wherein the forward surface of the second back leg is oriented at an acute angle with respect to the rear surface of the second tongue.

4. A surface covering comprising:

a plurality of unitary panels as in claim 3, the plurality of panels comprising a first panel and a second panel; and grout between the first panel and the second panel.

5. A panel comprising:

a face portion defining a face surface of the panel; and a back portion connected to the face portion and defining a back surface of the panel, wherein the face portion and the back portion cooperate to define:

opposing first and second sides of the panel that extend along a first axis and are spaced apart along a second axis that is perpendicular to the first axis; and opposing third and fourth sides of the panel that extend between the first and second sides along the second axis and are spaced apart along the first axis, wherein the face surface has:

a first edge and a second edge that extend along the first axis and are spaced by a width along the second axis; and a third edge and a fourth edge that extend along the second axis and are spaced by a length along the first axis, wherein the back surface is spaced from the face surface along a third axis that is perpendicular to the first and second axes, wherein the face portion has a consistent peripheral profile extending between the face surface and the back portion such that the length and width of the face surface respectively correspond to a length and a width of the face portion, and wherein the back portion has a variable profile along the third axis that defines:

a projection of the first side or the second side that has a longitudinal dimension along the first axis that is greater than the length of the face portion; or a projection of the third side or the fourth side that has a longitudinal dimension along the second axis that is greater than the width of the face portion.

6. The panel of claim 5, wherein the back portion defines a tongue on the first side of the panel that is greater than the length of the face portion.

7. The panel of claim 5, wherein the back portion defines a leg that defines a portion of a groove on the second side of the panel that is greater than the length of the face portion.

8. The panel of claim 5, wherein the back portion defines a tongue on the third side of the panel that is greater than the width of the face portion.

9. The panel of claim 5, wherein the back portion defines a leg that defines a portion of a groove on the fourth side of the panel that is greater than the width of the face portion.

* * * * *